US009334810B2

(12) United States Patent
Yamazaki

(10) Patent No.: US 9,334,810 B2
(45) Date of Patent: May 10, 2016

(54) WORKING MACHINE

(71) Applicant: Honda Motor Co., Ltd., Tokyo (JP)

(72) Inventor: Nobuo Yamazaki, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 729 days.

(21) Appl. No.: 13/763,790

(22) Filed: Feb. 11, 2013

(65) Prior Publication Data

US 2013/0269655 A1 Oct. 17, 2013

(30) Foreign Application Priority Data

Apr. 13, 2012 (JP) ..... 2012-091867

(51) Int. Cl.

| | |
|---|---|
| ***F02D 9/10*** | (2006.01) |
| ***F02D 11/02*** | (2006.01) |
| ***F02D 11/04*** | (2006.01) |
| *F02D 9/02* | (2006.01) |

(52) U.S. Cl.

CPC ..... *F02D 9/1065* (2013.01); *F02D 11/02* (2013.01); *F02D 11/04* (2013.01); *F02D 2009/0254* (2013.01); *F02D 2009/0255* (2013.01)

(58) Field of Classification Search

CPC ..... F02M 2700/126; F02M 2700/4323; F02D 11/02; F02D 11/04; F02D 2009/0201; F02D 2009/0208; F02D 2009/022; F02D 2009/023; F02D 2009/0235; F02D 2009/0254; F02D 9/1065

USPC ..... 180/332, 334, 335, 68.3

See application file for complete search history.

(56) References Cited

U.S. PATENT DOCUMENTS

| | | | | |
|---|---|---|---|---|
| 4,524,741 | A * | 6/1985 | Corbi | F02D 11/02 123/337 |
| 4,856,476 | A * | 8/1989 | Shirakawa | F02D 11/107 123/342 |
| 5,002,146 | A * | 3/1991 | Sakai | B60K 28/16 123/342 |
| 5,538,449 | A * | 7/1996 | Richard | B63H 21/213 440/1 |

(Continued)

FOREIGN PATENT DOCUMENTS

| | | | |
|---|---|---|---|
| JP | 2000-054865 | A | 2/2000 |
| JP | 2000-248975 | A | 9/2000 |
| JP | 2011-11675 | A | 1/2011 |

OTHER PUBLICATIONS

Japanese Office Action dated Jul. 28, 2015, issued in counterpart Japanese application No. 2012-091867.

*Primary Examiner* — Erick Solis
*Assistant Examiner* — Anthony L Bacon
(74) *Attorney, Agent, or Firm* — Westerman, Hattori, Daniels & Adrian, LLP

(57) ABSTRACT

A working machine includes a throttle cable for transmitting an amount of operation of a throttle lever to a throttle valve, upper and lower guide rollers for guiding the throttle cable, and a throttle cable tightening/loosening means including a pivotable arm portion having a pressing roller located between the upper and lower guide rollers. The working machine further includes connecting means interconnecting the arm portion and a clutch lever. Operation of the clutch lever moves the pressing roller between a tightening position to tighten the throttle cable and a slackening position to slacken the throttle cable.

3 Claims, 27 Drawing Sheets

(56) References Cited

U.S. PATENT DOCUMENTS 5,758,546 A * 6/1998 Taomo ..... F02B 63/02 74/488
8,403,102 B2 * 3/2013 Raasch ..... B60K 26/04 180/335
2006/0086199 A1 * 4/2006 Dircks ..... F02D 11/02 74/502.6
2006/0130808 A1 * 6/2006 Steffes ..... F02D 9/02 123/376
2007/0251484 A1 * 11/2007 Pattullo ..... F02D 11/02 123/185.3
2009/0229567 A1 * 9/2009 Taylor ..... F02D 11/02 123/339.13

* cited by examiner

FIG.12A
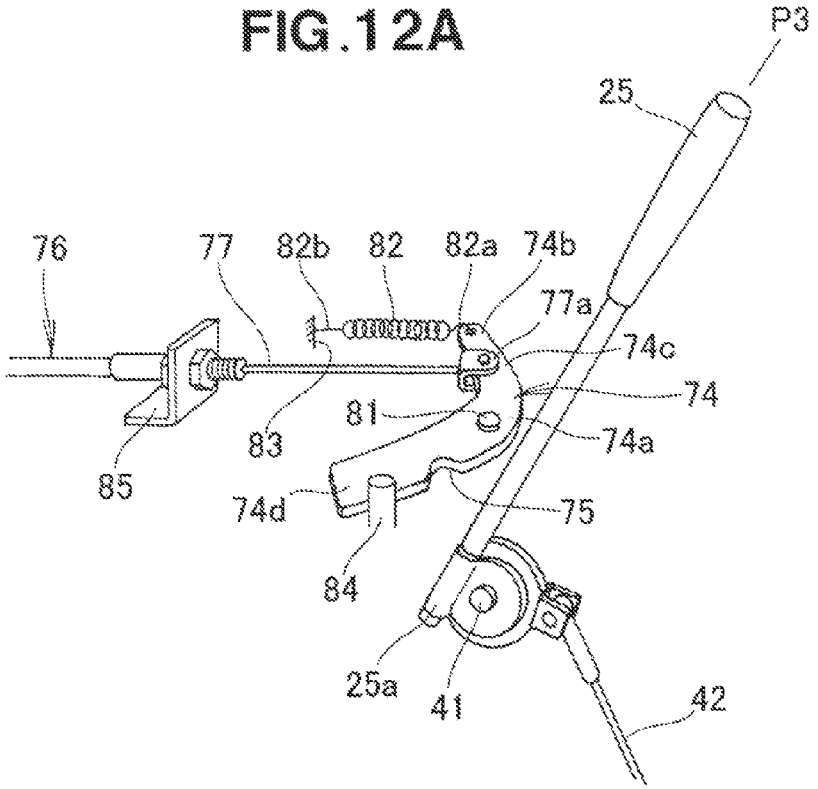
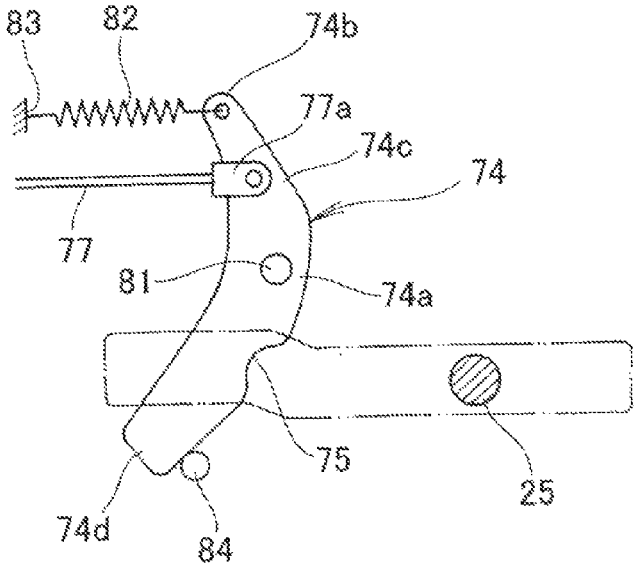
FIG.12B

23
P2
P3
82
25
P6
O
P7
27
27
77
74
55
46
59
58
73
56
P8
P11
46b
14
14b
45

23
P2
P3
82
25
P6
P
P7
27
27
77
74
55
46
59
58
73
56
P8
P10
46b
14
14b
45

WORKING MACHINE

CROSS-REFERENCED TO RELATED APPLICATIONS

This application is based upon and claims priority to Japanese Application No. 2012-091867, filed Apr. 13, 2012, the disclosure of which is hereby incorporated in its entirety by reference.

FIELD OF THE INVENTION

The present invention relates to a working machine designed to control a speed of an engine of the machine in correspondence to an operated or non-operated position of the working machine.

BACKGROUND OF THE INVENTION

A known working machine has an engine speed electrically controlled in correspondence to an operated or non-operated state of the working machine, as disclosed in JP-A-2000-248975. The engine speed is controlled to decrease upon detection of information indicating that the working machine is switched from the operated state to the non-operated state. The engine speed is also controlled to increase upon detection of information indicating that the working machine is switched from the non-operated state to the operated state.

To control the engine speed in correspondence to the operated state or the non-operated state, the working machine of JP-A-2000-248975 includes a sensor for detecting an operation of switching the working machine to the operated state or the non-operated state. The sensor transmits to a control unit a signal indicative of the detection of the switching operation. Upon receiving the signal from the sensor, the control unit transmits to an actuator a signal to adjust the engine speed. These electric components required to adjust the engine speed, such as the sensor, the control unit and the actuator causes a barrier to reducing a cost of the working machine.

An object of the present invention is to provide a working machine inexpensively constructed to control an engine speed in correspondence to an operated state or a non-operated state of the working machine.

SUMMARY OF THE INVENTION

According to one aspect of the present invention, there is provided working machine comprising: an engine; engine speed controlling means for controlling a speed of the engine; a throttle lever; a throttle cable interconnecting the throttle lever and the engine speed controlling means for transmitting an amount of operation of the throttle lever to the engine speed controlling means; a plurality of guide members spaced from one another for guiding the throttle cable; a throttle cable clamping portion located between the guide members for pressing the throttle cable against the guide members so as to tighten the throttle cable; a pivotable arm portion having the throttle cable clamping portion; connecting means connected to the arm portion; and operating means connected to the connecting means and operable to move the throttle cable clamping portion between a tightening position to press the throttle cable against the guide members so as to tighten the throttle cable and a slackening position to slacken the throttle cable.

The throttle cable clamping portion is carried on the arm portion connected through the connecting means to the operating means. The operating means is operable to move the throttle cable clamping portion between the tightening position and the slackening position.

When the operating means is operated to hold the cable clamping portion in the tightening position, the throttle cable is held tight. The tight throttle cable can transmit the amount of operation of the throttle lever to the engine speed controlling means for adjusting the engine speed to a high speed. When the operating means is operated to hold the throttle cable clamping portion in the slackening position, the throttle cable is held slack. The slack throttle cable does not transmit the amount of operation of the throttle lever and hence allows the engine speed controlling means to adjust the engine speed to a low speed.

Thus, the operation of the operating means to hold the throttle cable clamping portion in the tightening position allows the engine speed controlling means to adjust the engine speed to the high speed. The operation of the operating means to hold the throttle cable clamping portion in the slackening portion allows the engine speed controlling means to adjust the engine speed to the low speed. That is, by switching the operating means between an operated position and a non-operated position, the engine speed can be automatically adjusted between the high and low speeds in correspondence to the position of the switched operating means.

Further, a mechanism for automatically adjusting the engine speed to the high or low speed is formed by mechanical members including the guide members, the arm portion, the throttle cable clamping portion and the connecting means. This means that this mechanism for automatically adjusting the engine speed does not use electrical components, which leads to reducing a cost of the working machine.

In a preferred form of the invention, the working machine further comprises pulling means connected to the arm portion for pulling the arm portion to urge the throttle cable clamping portion to the tightening position, wherein the operating means is switchable to an non-operated position to move the throttle cable clamping portion to the slacking position against an urging force exerted by the pulling means on the throttle cable clamping portion.

When the operating means is held in the operated position, the throttle cable clamping portion is held in the tightening position by the pulling means such that the engine speed can be adjusted to a high speed. When the operating means is switched to the non-operated position to move the throttle cable clamping portion to the slackening position, the engine speed can be adjusted to a low speed. By switching the operating means to the operated position or the non-operated position, the engine speed can be automatically adjusted to the high or low speed in correspondence to the position of the switched operating means.

In a further preferred form of the invention, the working machine further comprises urging means connected to the arm portion for urging the throttle cable clamping portion to the slackening position, wherein the operating means s switchable to an operated position to move the throttle cable clamping portion to the tightening position against an urging force exerted by the urging means on the throttle cable clamping portion.

When the operating means is held in the non-operated position, the throttle cable clamping portion is held in the slackening position by the urging means such that the engine speed can be adjusted to a low speed. When the operating means is switched to the operated position to move the throttle cable clamping portion to the tightening position, the engine speed can be adjusted to a high speed. By switching the operating means to the operated position or the non-operated position, the engine speed can be automatically adjusted to the high or low speed in correspondence to the position of the switched operating means.

BRIEF DESCRIPTION OF THE DRAWINGS

Certain preferred embodiments of the present invention will hereinafter be described in detail, by way of example only, with reference to the accompanying drawings, in which:

FIG. 12A is a perspective view of a control mechanism of the working machine of FIG. 11 with a shift lever of FIG. 11 set in a forward travel position and FIG. 12B is a plan view of the control mechanism of FIG. 12A with the shift lever set of FIG. 11 in the forward travel position;

DETAILED DESCRIPTION OF THE PREFERRED EMBODIMENTS

It is noted that working machines in first to fifth embodiments are walk-behind snow throwers, but may be other types of working machines such as tillers and bush cutters.

The working machine 10 in the first embodiment of the present invention will be discussed below.

Figure 1:
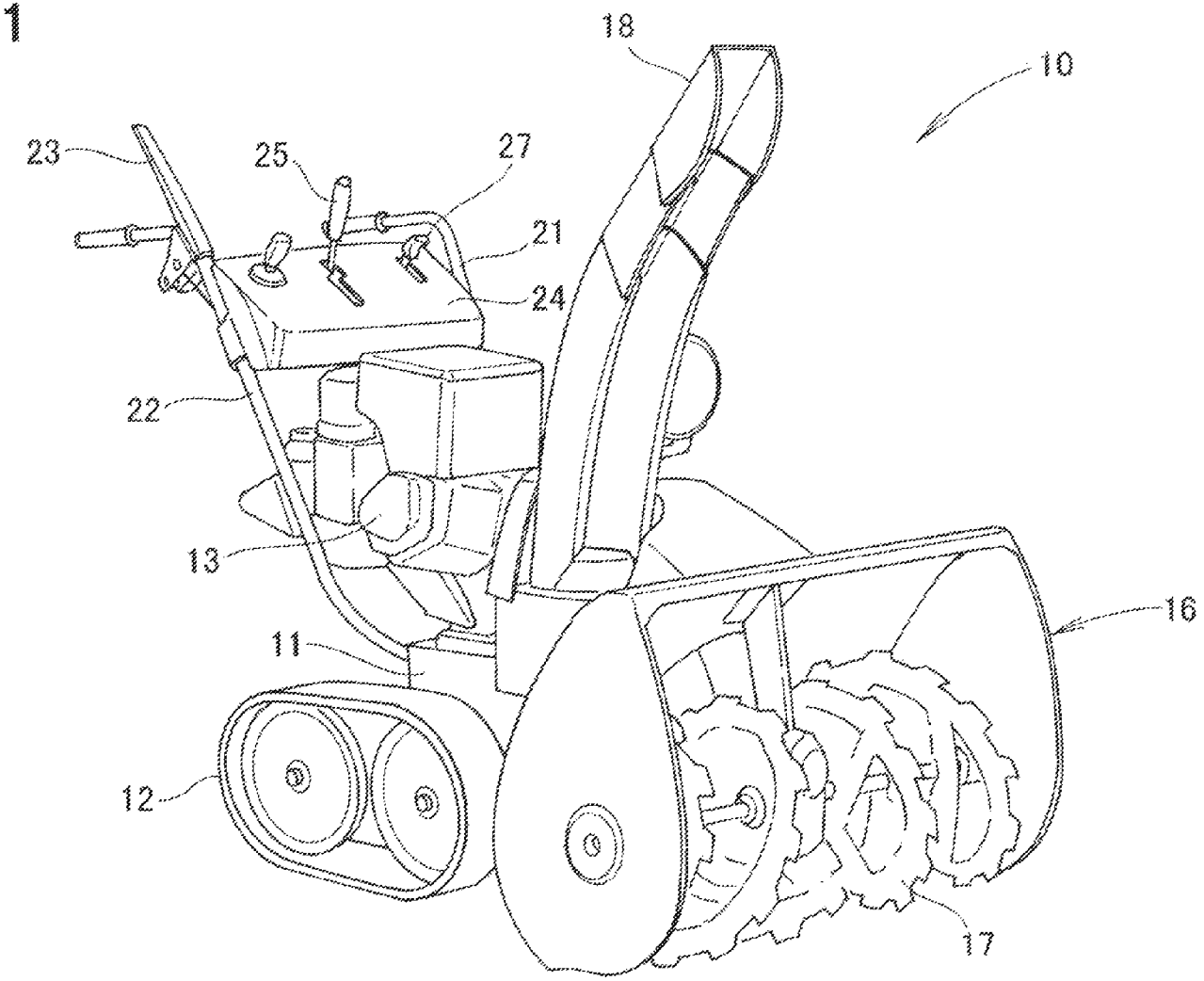
FIG. 1 is a perspective view of a working machine in a first embodiment of the present invention.

As shown in FIG. 1, the working machine 10 includes a machine body 11, and traveling mechanisms 12 disposed on lower parts of the machine body 11. The working machine 10 also includes an engine 13 disposed on an upper part of the machine body 11, a snow-removing mechanism 16 disposed on a front part of the machine body 11, and left and right operational rods 21, 22 extending rearward and upward from a rear part of the machine body 11.

The working machine 10 further includes a clutch lever (operating means) 23 disposed on an upper part of the right operational rod 22, and a control panel 24 interconnecting and extending between the upper parts of the left and right operational rods 21, 22. The working machine 10 further includes a shift lever (operating means) 25 extending upward from the control panel 24, a throttle lever 27 disposed leftward of the shift lever 25, and a control mechanism 31 (FIG. 2) operable in response to operation of the clutch lever 23 as will be detailed later.

The working machine 10 is capable of removing snow by the snow-removing mechanism 16, traveling forward on the traveling mechanisms 12.

The snow-removing mechanism 16 includes an auger 17 rotatable to collect snow at a lateral center of the auger 17, and a blower (not shown) for blowing the collected snow upward out of a chute 18 for discharging the snow out of the working machine 10.

Figure 2:
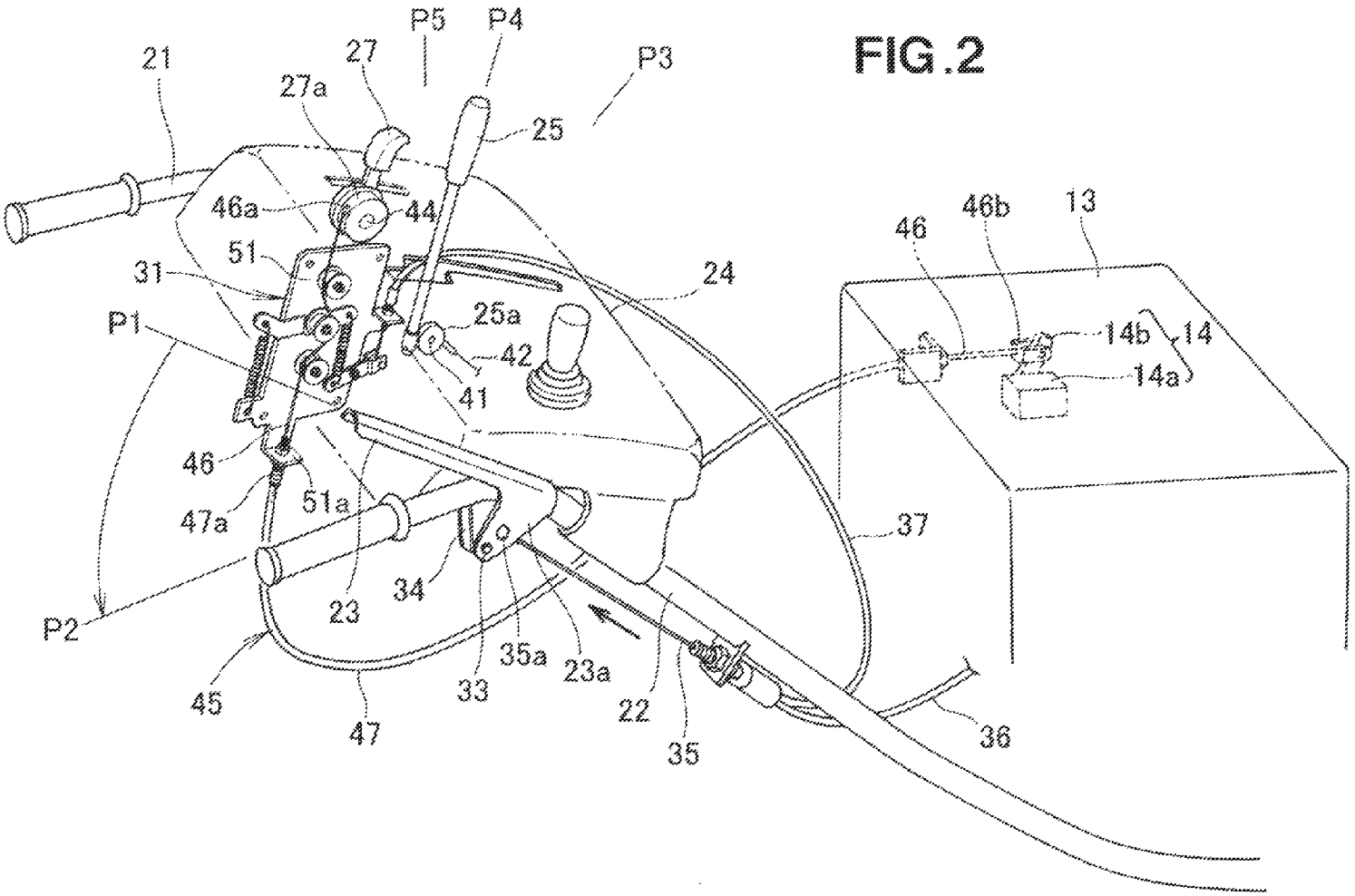
FIG. 2 is a perspective view of a control mechanism and a variety of levers of the working machine in the first embodiment.

As shown in FIG. 2, the engine 13 is provided with a throttle valve (engine speed controlling means) 14 adapted to control an amount of fuel to be fed to a combustion chamber of the engine 13.

The throttle valve 14 includes a valve body 14*a* mounted on the engine 13, and a throttle arm 14*b* disposed on the valve body 14*a*. Operation of the throttle arm 14*b* controls the amount of the fuel to control a speed of the engine 13.

The clutch lever 23 is pivotable and has a base 23*a* attached through a support pin 33 to an upper bracket 34 carried on the right operational rod 22. That is, the clutch lever 23 is supported by the upper bracket 34 in such a manner as to pivot on the support pin 33 between a clutch disengaged position (non-operated position) P1 and a clutch engaged position (operated position) P2. Connected to the clutch lever 23 above the support pin 33 is one end 35*a* of a clutch cable 35.

The clutch cable 35 is bifurcated into a first clutch cable 36 and a second clutch cable 37. The first clutch cable 36 is connected to a clutch (not shown). The second clutch cable 37 is connected to the control mechanism 31.

Pivotal movement of the clutch lever 23 from the clutch disengaged position P1 to the clutch engaged position P2, as indicated by an arrow, pulls the clutch cable 35 in a direction of an arrow to thereby pull the first and second clutch cables 36, 37. By pulling the first clutch cable 36, the clutch is switched to an engaged state to allow transmission of power of the engine 13 to the traveling mechanisms 12 (FIG. 1). By pulling the second clutch cable 37, the control mechanism 31 is actuated by the pulled second clutch cable 37, as will be detailed later.

When an operator releases his hand from the clutch lever, the clutch lever 23 is returned to the clutch disengaged position P1 under a spring force of a return spring (not shown).

The returning of the clutch lever 23 to the clutch disengaged position P1 releases the first clutch cable 36 from the pulled position, thereby moving the clutch to a disengaged state to stop the transmission of the power of the engine 13 to the traveling mechanisms 12 (FIG. 1).

The returning of the clutch lever 23 to the clutch disengaged position P1 also releases the second clutch cable 37 from the pulled position, thereby making the second clutch cable 37 stop actuating the control mechanism 31.

The movement of the clutch lever 23 between the clutch disengaged position P1 and the clutch engaged position P2 switches the clutch between the disengaged state to stop the transmission of the power of the engine 13 and the engaged state to allow the transmission of the power of the engine 13.

In addition, the movement of the clutch lever 23 between the clutch disengaged position P1 and the engaged position P2 switches the second clutch cable 37 between the released position to stop actuating the control mechanism 31 and the pulled position to actuate the control mechanism 31.

The shift lever 25 has a disc-shaped proximal end 25*a* rotatably supported by a mounting bracket (not shown) through a support pin 41. It is noted that the mounting bracket is disposed on a cross member (not shown) interconnecting and extending between the left and right operational rods 21, 22.

Rotation of the proximal end 25*a* on the support pin 41 switches the shift lever 25 to any one of a forward, travel position (operated position) P3, a neutral position P4 and a reverse travel position (non-operated position) P5.

The proximal end 25*a* of the shift lever 25 is connected through a transmission cable 42 to a transmission mechanism (not shown).

The switching of the shift lever 25 to the forward travel position P3 switches the transmission mechanism to a forward travel mode to enable the working machine 10 to travel forward.

The switching of the shift lever 25 to the neutral position P4 switches the transmission mechanism to a neutral mode to keep the working machine 10 from traveling.

The switching of the shift lever 25 to the reverse travel position P5 switches the transmission mechanism to a reverse travel mode to enable the working machine 10 to travel backward.

The throttle lever 27 has a disc-shaped proximal end 27*a* rotatably supported by a mounting bracket (not shown) through a support pin 44. The mounting bracket is disposed on a cross member (not shown) interconnecting and extending between the left and right operational rods 21, 22.

Figure 3:
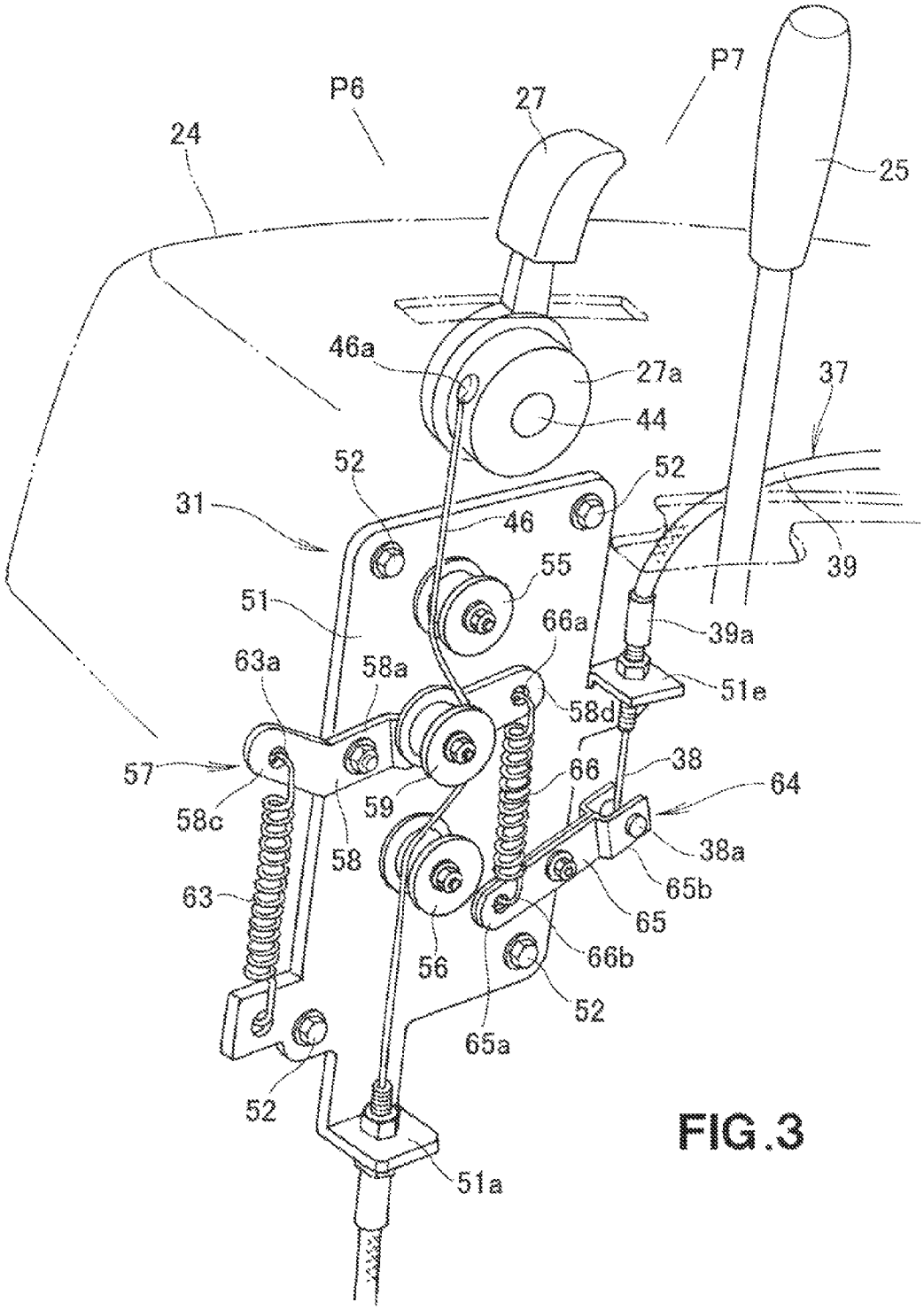
FIG. 3 is a perspective view of the control mechanism shown in FIG. 2.

Rotation of the proximal end 27*a* on the support pin 44 moves the throttle lever 27 between a low engine speed position P6 (FIG. 3) and a high engine speed position P7 (FIG. 3).

The proximal end 27*a* of the throttle lever 27 is connected to the throttle arm 14*b* of the throttle valve 14 through a throttle cable 45.

More specifically the throttle cable 45 includes an inner cable 46 having a proximal end 46*a* connected to the proximal end 27*a* of the throttle lever 27, and an outer tube 47 having a proximal end 47*a* attached to a lower flange 51*a* of a support plate 51 of the control mechanism 31. The inner cable 46 has a distal end 46*b* connected to the throttle arm 14*b* of the throttle valve 14. The throttle cable 45 is adapted to be guided by the control mechanism 31, transmitting an amount of operation or movement of the throttle lever 27 to the throttle arm 14*b*, as will be detained later.

Figure 4:
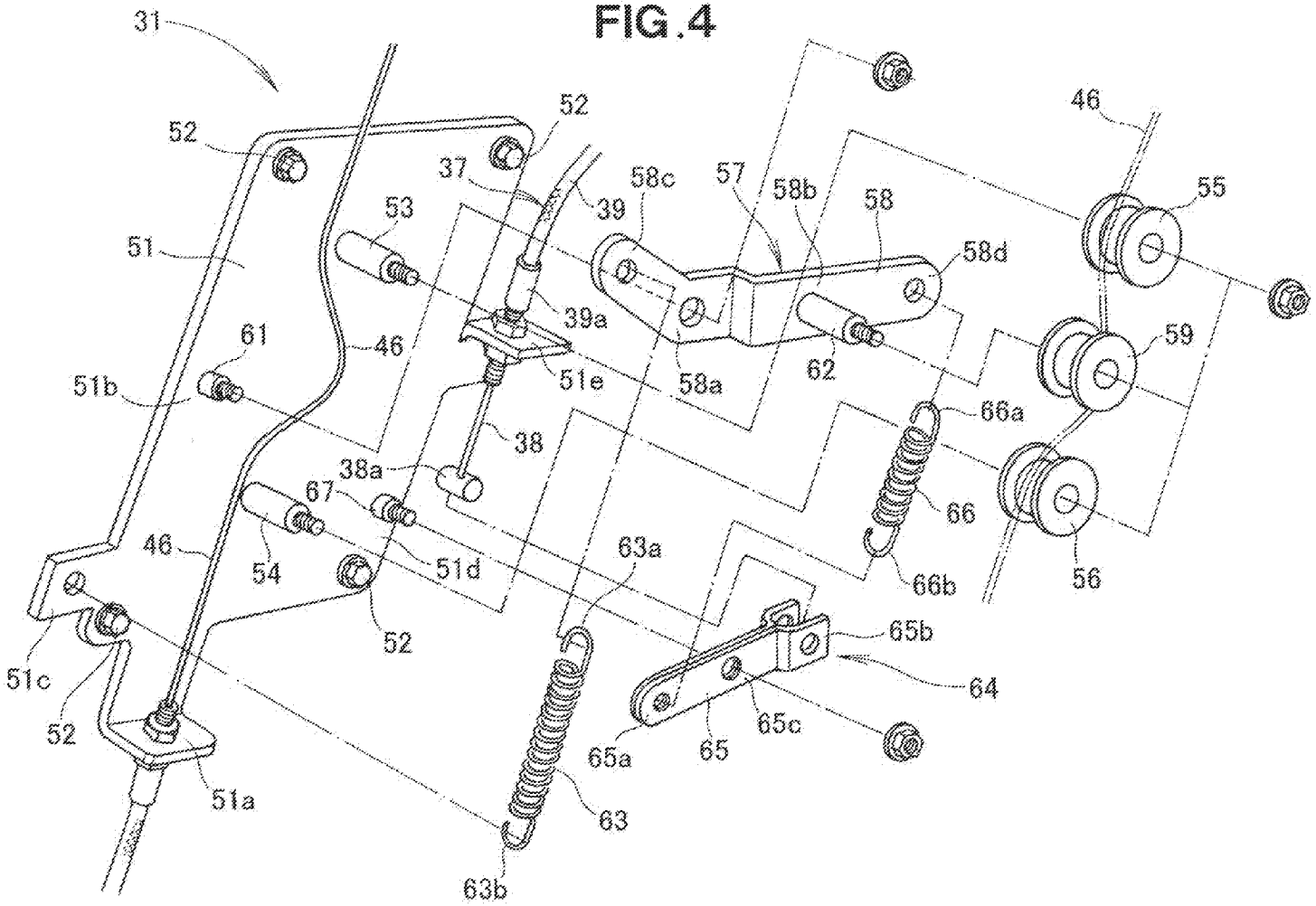
FIG. 4 is an exploded perspective view of the control mechanism shown in FIG. 3.

As shown in FIG. 3 and FIG. 4, the support plate 51 of the control mechanism 31 is attached to mounting brackets (not shown) through bolts 52. The control mechanism 31 includes upper and lower guide rollers (plural guide members) 55, 56 rotatably supported by the support plate 51 through upper and lower support pins 53, 54. The control mechanism 31 also includes throttle cable tightening/loosening means 57 for pressing the throttle cable 45 (the inner cable 46) against the upper and lower guide rollers 55, 56 such that the throttle cable 45 is tightened, as will be detailed later. The mounting brackets are disposed on cross members (not shown) interconnecting and extending between the left and right operational rods 21, 22 (FIG. 2).

The control mechanism 31 further includes a return spring (urging means) 63 for urging the throttle cable tightening/loosening means 57 in a direction away from the upper and lower guide rollers 55, 56 such that the throttle cable 45 is slackened, as will be detailed later. The control mechanism 31 further includes connecting means 64 for moving the throttle cable tightening/loosening means 57 against a spring force (an urging force) of the return spring 63, as will be detailed later.

The upper guide roller 55 is rotatably supported on the upper support pin 53. The lower guide roller 56 is rotatably supported on the lower support pin 54.

The upper and lower guide rollers 55, 56 are vertically spaced from each other below the throttle lever 27. The upper and lower guide rollers 55, 56 are adapted to guide the inner cable 46 of the throttle cable 45 extending from the throttle lever 27.

The throttle cable tightening/loosening means 57 includes an arm portion 58 pivotably supported by the support plate 51 through support pin 61. The throttle cable tightening/loosening means 57 also includes a pressing roller (throttle cable clamping portion) 59 rotatably supported by the arm portion 58 through a support pin 62.

The arm portion 58 is generally horizontally oriented with a rear side 58*a* of a center thereof being supported via the support pin 61 by a rear middle portion 51*b* of the support plate 51. The pressing roller 59 is rotatably supported via the support pin 62 by a front side 58*b* of the center of the arm portion 58. The front side 58*b* is located forward of the support pin 61.

The pressing roller 59 is disposed between the upper and lower guide rollers 55, 56 for guiding the inner cable 46 of the throttle cable 45.

The arm portion 58 has a rear end 58*c* connected (locked) to an upper hook 63*a* of the return spring 63. The return spring 63 has a lower hook 63*b* connected (locked) to a rear lower end 51*c* of the support plate 51. The rear end 58*c* of the arm portion 58 is urged downward by a spring force of the return spring 63. The arm portion 58 has a front end 58*d* connected (locked) to an upper hook 66*a* of a connecting spring 66 of the connecting means 64.

The front end 58*d* of the arm portion 58 is adapted to be pulled downward by the connecting spring 66 of the connecting means 64 when the control mechanism 31 is actuated by the second clutch cable 37 pulled in the manner stated above, such that the arm portion 58 turns clockwise against the spring force of the return spring 63. The clockwise turning of the arm portion 58 shifts the pressing roller 59 downward and forward between the upper and lower guide rollers 55, 56 so as to bring the pressing roller 59 to a tightening position P8 (FIG. 6) to press the throttle cable 45 (the inner cable 46) against the upper and lower guide rollers 55, 56 for tightening the inner cable 46. With the pressing roller 59 being held in the tightening position P8 by the connecting spring 66 pulling the front end 58*d*, the inner cable 46 is held tight between the pressing roller 59 and the upper and lower guide rollers 55, 56.

When the second clutch cable 37 is released from the pulled position to stop actuating the control mechanism 31 in the manner discussed above, on the other hand, the arm portion 58 turns counterclockwise under the downward-directed spring force exerted by the return spring 63 on the rear end 58*c* of the arm portion 58. The counterclockwise turning of the arm portion 58 shifts the pressing roller 59 upward and rearward between the upper and lower guide rollers 55, 56 so as to bring the pressing roller 59 to a slackening position P9 (FIG. 5) to slacken the throttle cable 45 (the inner cable 46). In the slackening position P9, the pressing roller 59 stops pressing the inner cable 46 against the upper and lower guide rollers 55, 56. With the pressing roller 59 being held in the slackening position P9 by the return spring 63 exerting the spring force on the rear end 58*c*, the inner cable 46 is held slack.

The connecting means 64 includes a pulling arm 65 pivotally supported by a front lower portion 51*d* of the support plate 51. The connecting spring 66 of the connecting means 64 is connected (locked) to a rear end 65*a* of the pulling arm 65 and to the front end 58*d* of the arm portion 58 of the throttle cable tightening/loosening means 57. The second clutch cable 37 constitutes part of the connecting means 64 and is connected to a front end 65*b* of the pulling arm 65.

The pulling arm 65 is generally horizontally oriented with its center 65*c* being supported via a support pin 67 by the front lower portion 51*d* of the support plate 51. The pulling arm 65 is located forward of the upper and lower guide rollers 55, 56.

Figure 5:
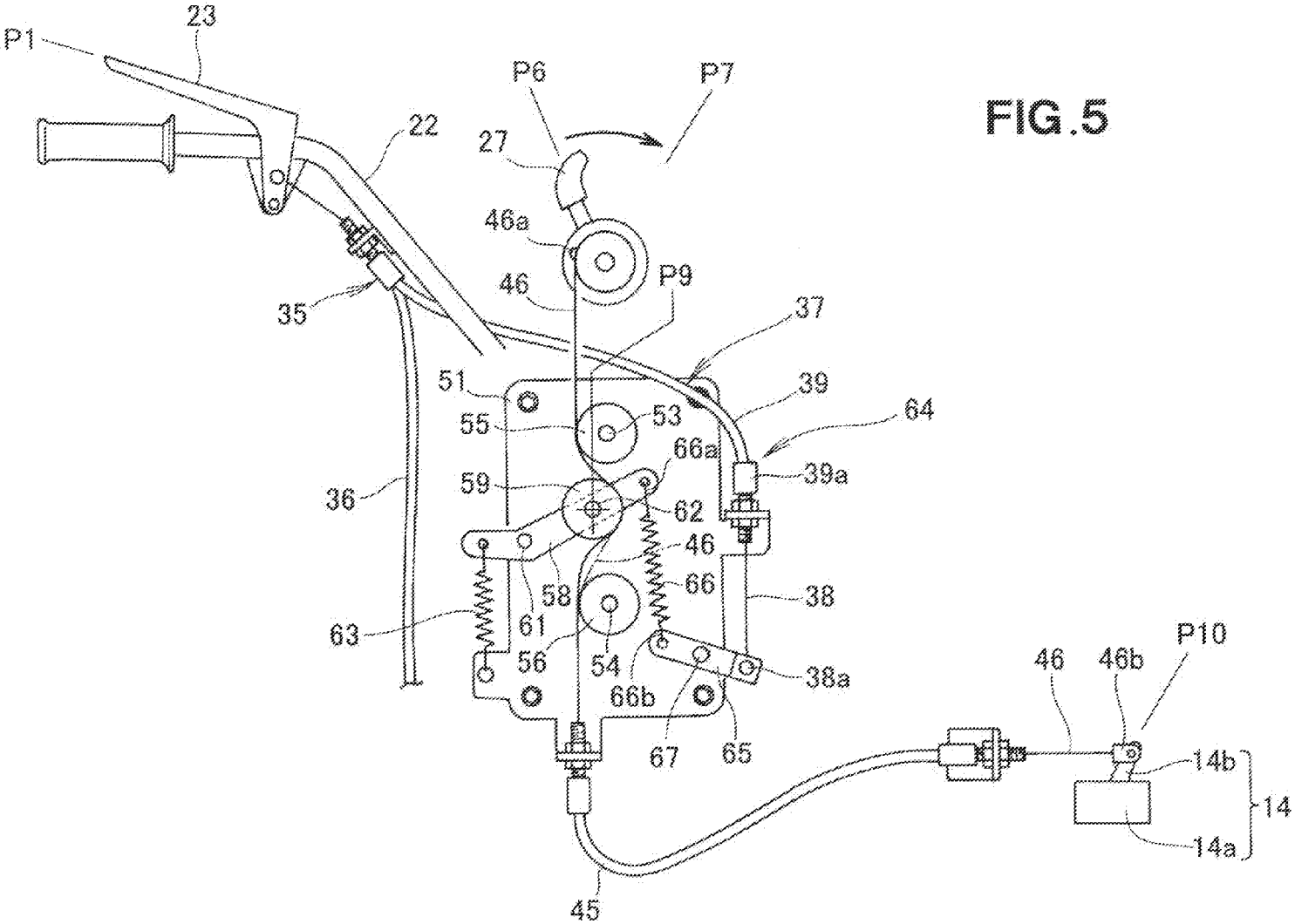
FIG. 5 is a side elevation view of the control mechanism of FIG. 2 holding a throttle cable slack.

As shown in FIG. 3 and FIG. 5, the second clutch cable 37 branches off from the first clutch cable 36 and includes an inner cable 38 having a distal end 38*a* connected to the front end 65*b* of the pulling arm 65. The second clutch cable 37 also includes an outer tube 39 having a distal end 39*a* attached to a front flange 51*e* of the support plate 51.

When the clutch lever 23 is switched to the clutch disengaged position (non-operated position) P1, the second clutch cable 37 stops actuating the control mechanism 31, whereupon the arm portion 58 turns counterclockwise under the spring force of the return spring 63, as discussed above. The counterclockwise turning of the arm portion 58 moves the pressing roller 59 to the slackening position P9. With the pressing roller 59 set in the slackening position P9, the inner cable 46 of the throttle cable 45 is held slack. Next, the throttle lever 27 moves from the low engine speed position P6 to the high engine speed position P7, as indicated, by an arrow of FIG. 5. The inner cable 46 of the throttle cable 45 then shifts to a position, shown by a phantom line, to remove a slack in the inner cable 46, whereupon the distal end 46*b* of the inner cable 46 remains unmoved. In other words, because of the slackening position P9 of the pressing roller 59, the inner cable 46 does not move the throttle arm 14*b* of the throttle valve 14 although the slack in the inner cable 46 is removed by the movement of the throttle lever 27 to the high engine speed position P7. Even with the throttle lever 27 set in the high engine speed position P7, thus, the throttle arm 14*b* of the throttle arm 14 remains in a low speed position P10 to provide a low speed of the engine 13.

When the clutch lever 23 is switched to the clutch disengaged position P1 with the throttle lever 27 set in the high engine speed position P7 and the throttle arm 14*b* set in a high speed position P11 to provide a high speed of the engine 13, the throttle arm 14*b* is returned to the low speed position P10 under a spring force of a return spring (not shown). This returning of the throttle arm 14*b* to the low speed position P10 reduces a speed of the engine 13.

Figure 6:
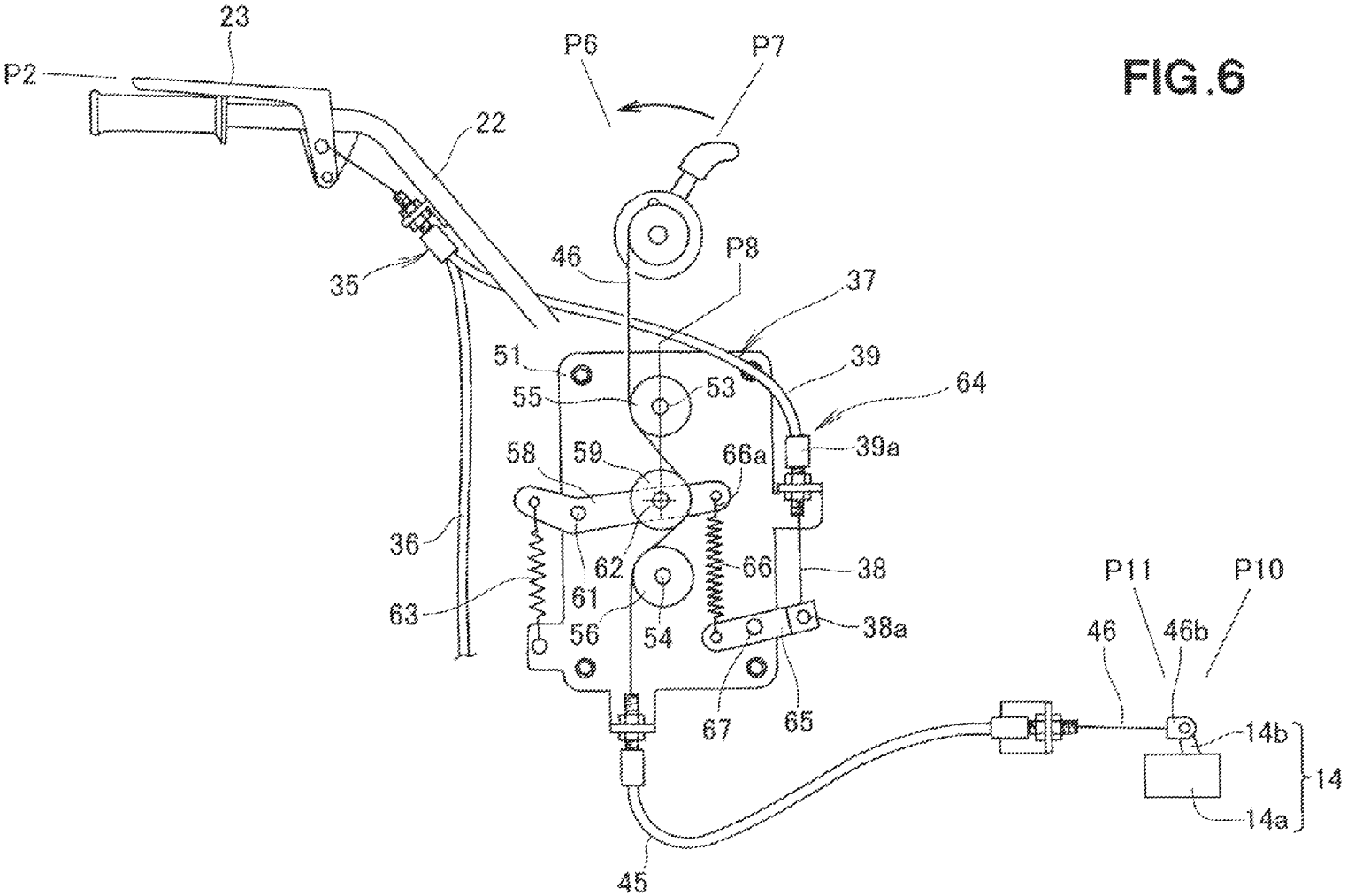
FIG. 6 is a side elevation view of the control mechanism of FIG. 2 actuated to tighten the throttle cable.

When the clutch lever 23 is switched to the clutch engaged position (operated position) P2 with the throttle lever 27 set in the high engine speed position P7, as shown in FIG. 6, the second clutch cable 37 is pulled to thereby actuate the control mechanism 31. More specifically, the distal end 38*a* of the inner cable 38 of the throttle cable 37 is pulled up to turn the pulling arm 65 counterclockwise such that the connecting spring 66 exerts a downward-directed pulling force on the arm portion 58. Under the pulling force of the connecting spring 66, the arm portion 58 turns clockwise against the force of the return spring 63. The clockwise turning of the arm portion 58 moves the pressing roller 59 to the tightening position P8. With the pressing roller 59 being held in the tightening position P8 by the connecting spring 66 exerting the pulling force on the arm portion 58, the throttle cable 45 (the inner cable 46) is held tight. Since the throttle lever 27 is in the high engine speed position with the throttle cable 45 being held tight, a speed of the engine 13 increases to a high speed. Then, throttle lever 27 moves from the high engine speed position P7 to the low engine speed position P6, as indicated by an arrow of FIG. 6. This movement of the throttle lever 27 to the low speed engine position P6 returns the throttle arm 14*b* of the throttle valve 14 to the low speed position P10, thereby reducing the speed of the engine 13 to a low speed.

From the foregoing, the working machine 10 in the first embodiment includes the clutch lever 23 movable between the clutch disengaged position (non-operated position) P1 and the clutch engaged position (operated position) P2 to switch the pressing roller 59 between the slackening position P9 and the tightening position P8. By switching the pressing roller 59 to the slackening position P9 or the tightening position P8, a speed of the engine 13 is adjusted to a low speed or a high speed. That is, by switching the clutch lever 23 to the non-operated position or the operated position, a speed of the engine 13 can be automatically adjusted to a low speed or a high speed. Furthermore, a mechanism for automatically adjusting an engine speed to a high or low speed is formed by only mechanism components including the second clutch cable 37, the upper and lower guide rollers 55, 56, the throttle cable tightening/loosening means 57, the return spring 63 and the connecting means 64. In other words, the mechanism for adjusting an engine speed can be made without using electrical components, which leads to cost reduction.

Discussion is made with reference to FIGS. 7A, 7B, 8A and 8B as to how to increase a speed of the engine 13 to remove a large quantity of snow during traveling of the working machine 10.

Figure 7A:
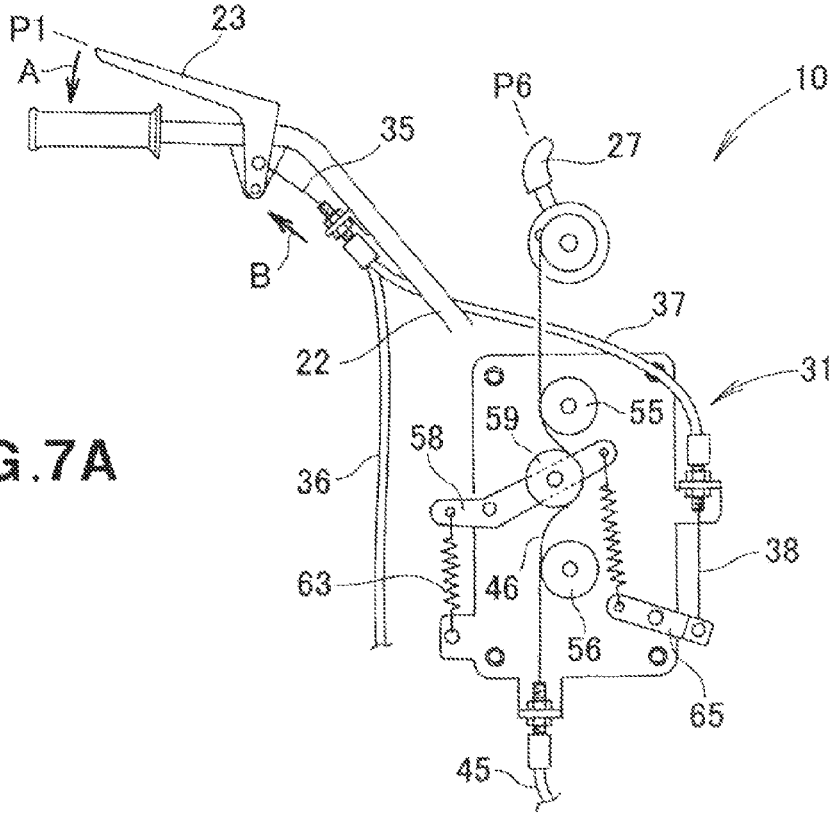
FIGS. 7A and 7B are views showing how to switch the throttle cable to a tight position, using a clutch lever.

As shown in FIG. 7A, the clutch lever 23 pivots from the clutch disengaged position (non-operated position) P1 toward the clutch engaged position (operated position) P2, as indicated by an arrow A. This pivoting of the clutch lever 23 pulls the clutch cable 35, as indicated by an arrow B.

Figure 7B:
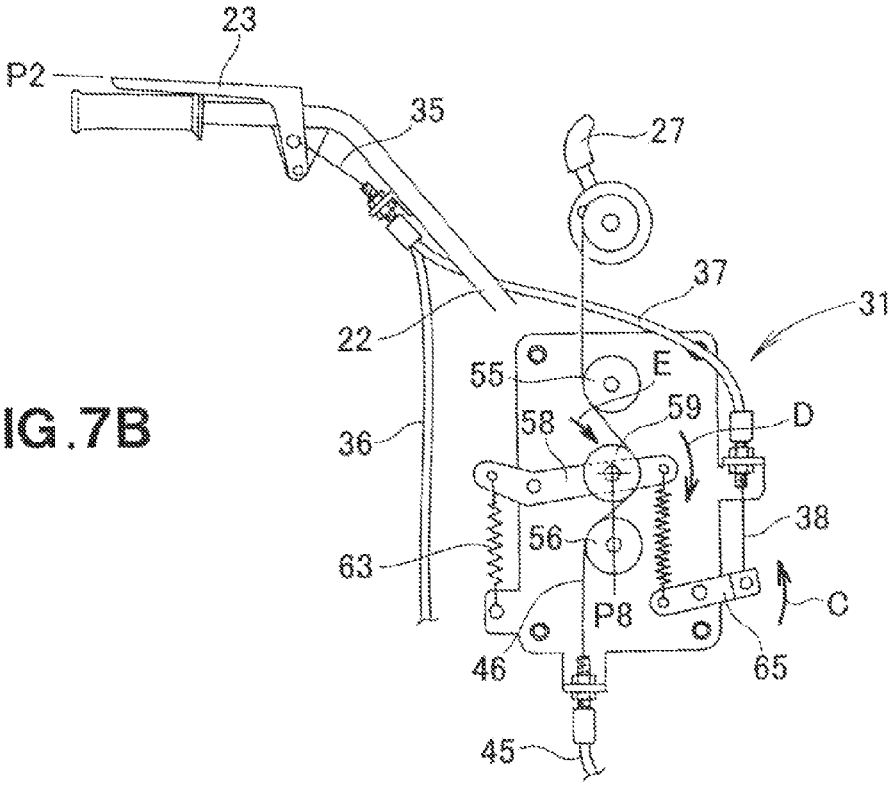

By switching the clutch lever 23 to the clutch engaged position P2 as shown in FIG. 7B, the first clutch cable 36 is pulled to bring the clutch to the engaged state to transmit a power of the engine 13 to the traveling mechanisms 12, such that the working machine 10 travels forward.

By switching the clutch lever 23 to the clutch engaged position P2, also, the inner cable 38 of the clutch cable 37 turns the pulling arm 65 counterclockwise as indicated by an arrow C. The counterclockwise turning of the pulling arm 65 turns the arm portion 58 clockwise, as indicated by an arrow D, against the spring force of the return spring 63. This moves the pressing roller 59 to the tightening position P8, as indicated by an arrow E, to tighten the inner cable 46 of the throttle cable 45.

Figure 8A:
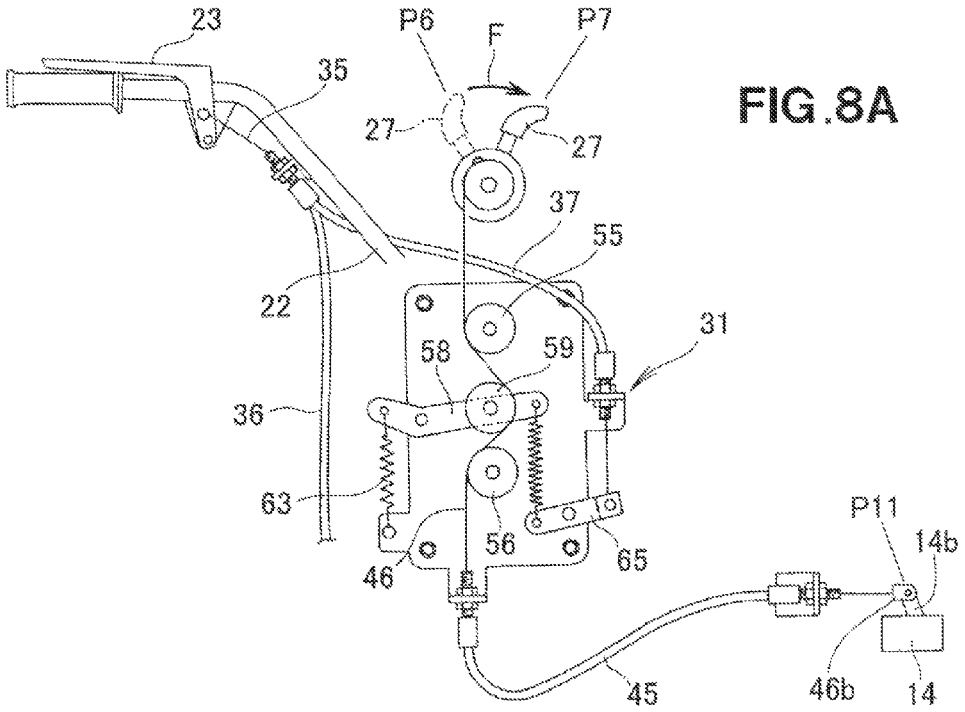
FIGS. 8A and 8B are views showing increase an engine speed with a clutch lever set in a clutch engaged position to allow the working machine to remove a large quantity of snow.

With the inner cable 46 being tightened, the throttle lever 27 moves from the low engine speed position P6 to the high engine speed position P7, as indicated by an arrow F of FIG. 8A. This movement of the throttle lever to the high engine speed position P7 pulls back the distal end 46*b* of the inner cable 46 to thereby move the throttle arm 14*b* of the throttle valve 14 to a high speed position P11 to adjust a speed of the engine 13 to a high speed.

Figure 8B:
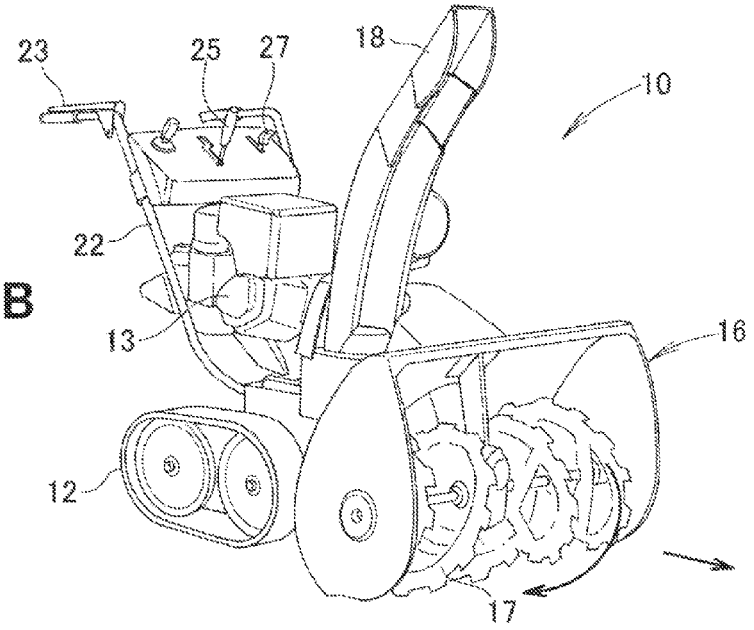

Turning to FIG. 8B, the auger 17 and the blower (not shown) of the snow-removing mechanism 16 operate at a high speed with the speed of the engine 13 being adjusted to the high speed. During the forward traveling of the working machine 10, the auger 17 collects a large quantity of snow at its lateral center and the blower blows the collected snow upward out of the chute 18.

Figure 9A:
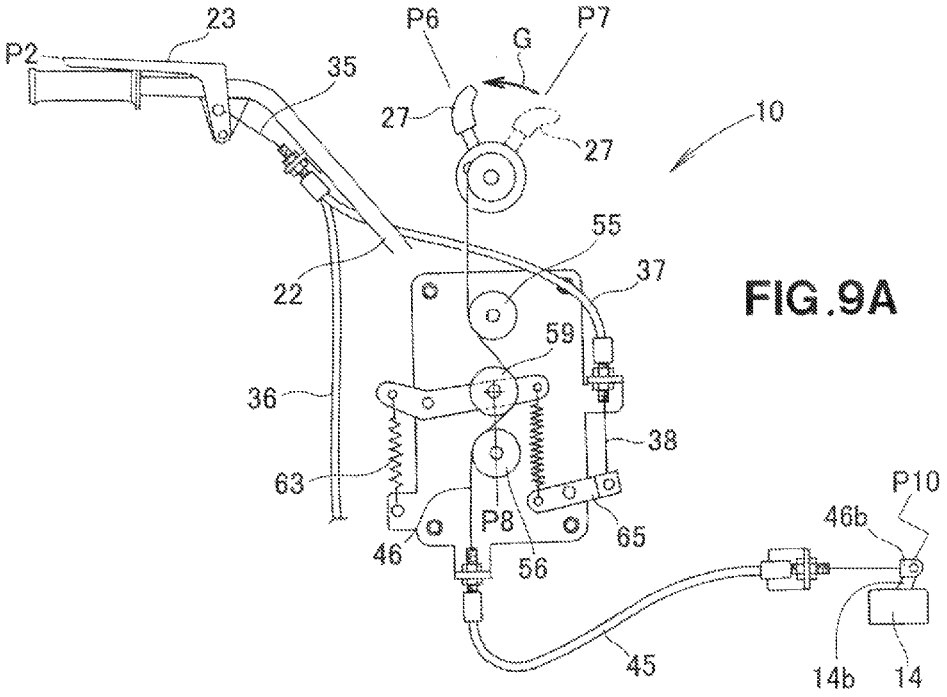
FIGS. 9A and 9B are views showing how to decrease the engine speed with the clutch lever set in the clutch engaged position to allow the working machine to remove a small quantity of snow.
Figure 9B:
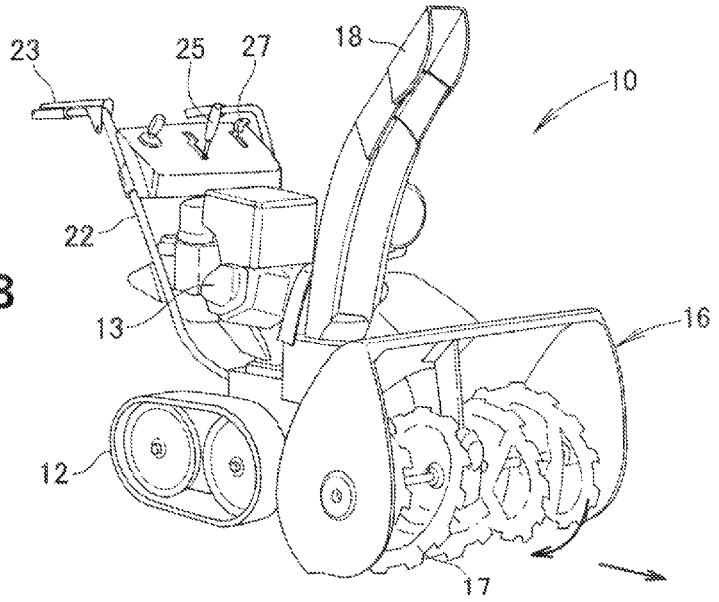

Discussion is made with reference to FIGS. 9A and 9B as to how to decrease a speed of the engine 13 to remove a small amount of snow during traveling of the working machine 10.

Reference is made to FIG. 9A. Since the clutch lever 23 is in the clutch engaged position P2, holding the pressing roller 59 in the tightening position P8, the inner cable 46 of the throttle cable 46 is held tight. The throttle lever 27 then moves from the high engine speed position P7 to the low engine speed position P6, as indicated by an arrow G. This movement of the throttle lever 27 to the low engine speed position P6 allows the throttle arm 14*b* of the throttle valve 14 to move, under the spring force of the return spring (not shown), to the low speed position P10 to decrease a speed of the engine 13.

Turning to FIG. 9B, the auger 17 and the blower (not shown) operate at a limited speed with the speed of the engine 13 being decreased. During forward traveling of the working machine 10, the auger 17 collects a small quantity of snow at its lateral center and the blower blows the collected snow upward out of the chute 18.

Figure 10A:
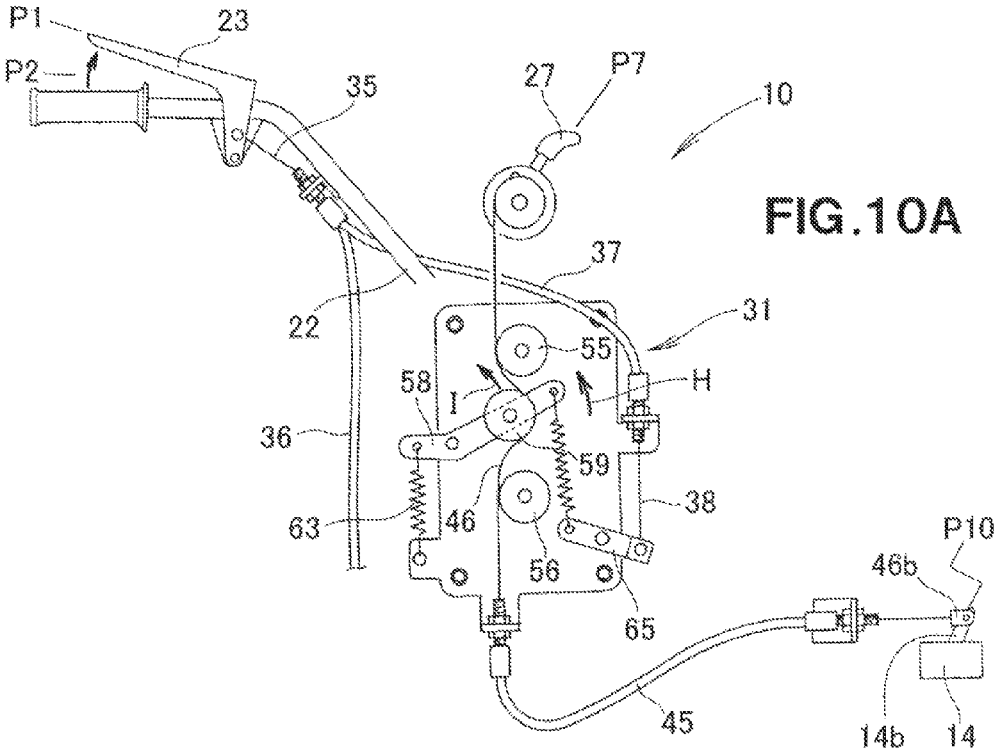
FIGS. 10A and 10B are views showing how to step the working machine during removal of snow.
Figure 10B:
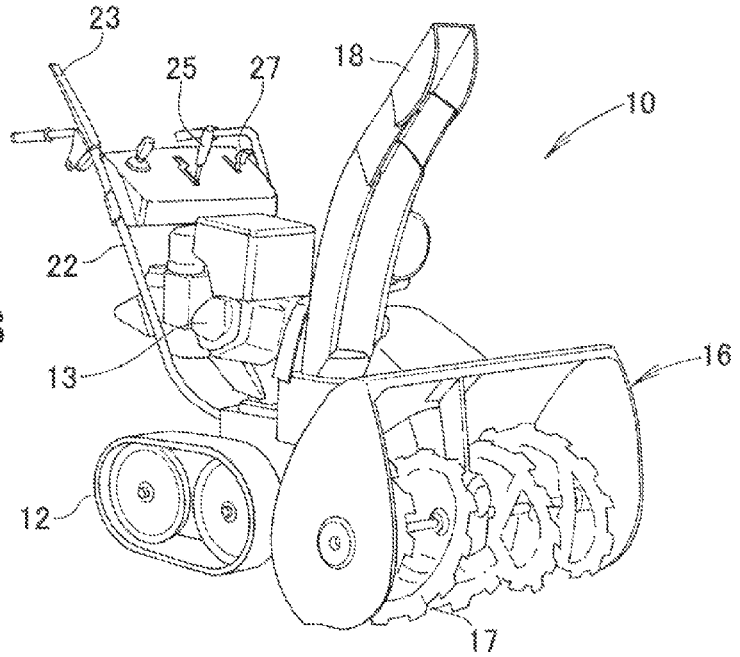

Discussion is made with reference to FIGS. 10A and 10B as to how to decrease a speed of the engine 13 while the working machine 10 stops traveling.

As shown in FIG. 10A, the clutch lever 23 is switched from the clutch engaged position P2 to the clutch disengaged position (non-operated position) P1, as indicated by an arrow, with the throttle lever 27 set in the high engine speed position P7. By switching the clutch lever 23 to the clutch disengaged position P1, the first clutch cable 36 is released from a pulled position, such that the clutch is brought to the disengaged state to stop transmission of a power of the engine 13 to the traveling mechanisms 12. As a result, the working machine 10 stops traveling.

By switching the clutch lever 23 from the clutch engaged position P2 to the clutch, disengaged position P1, also, the arm portion 58 is allowed to turn counterclockwise, as indicated by an arrow H, under the spring force of the return spring 63. The counterclockwise turning of the arm portion 58 moves the pressing roller 59, as indicated by an arrow I, to the slackening position P9 to slacken the inner cable 46 of the throttle cable 45. This allows the throttle arm 14*b* of the throttle valve 14 to return, under the spring force of the return spring (not shown), to the low speed position P10 to decrease a speed of the engine 13. This means that the speed of the engine 13 can automatically decrease by switching the clutch lever 23 to the clutch disengaged position P1.

Turning to FIG. 10B, the working machine 10 stops traveling while the auger 17 and the blower (not shown) of the snow-removing mechanism 16 operate at a limited speed. Thereafter, the clutch lever 23 is switched from the clutch disengaged position P1 to the clutch engaged position (operated position) P2. By switching the clutch lever 3 to the clutch engaged position P2, the clutch is brought to the engaged state, such that the working machine 10 starts to travel forward.

By switching the clutch lever 23 to the clutch engaged position P2, also, the pressing roller 59 moves to the tightening position P8 to tighten the inner cable 46 of the throttle cable 45. Upon tightening of the inner cable 46, the distal end 46*b* of the throttle cable 46 is pulled back to move the throttle arm 14*b* of the throttle valve 14 to the high speed position P11 because of the throttle lever 27 in the high engine speed position P7. This means that a speed of the engine 13 can be automatically adjusted to a high speed by switching the clutch lever 23 to the clutch engaged position P2. As a result, the auger 17 and the blower (not shown) of the snow-removing mechanism 16 operate at a high speed. Then, during forward traveling of the working machine 10, the auger 17 collects a large quantity of snow at its lateral center the blower blows the collected snow upward out of the chute 18.

The working machines in the second to fifth embodiments will be described below with reference to FIGS. 11 to 27. It is noted that elements of the working machines corresponding to those of the working machine 10 in the first embodiment are designated by the same reference numerals and, their detailed descriptions are omitted.

Figure 11:
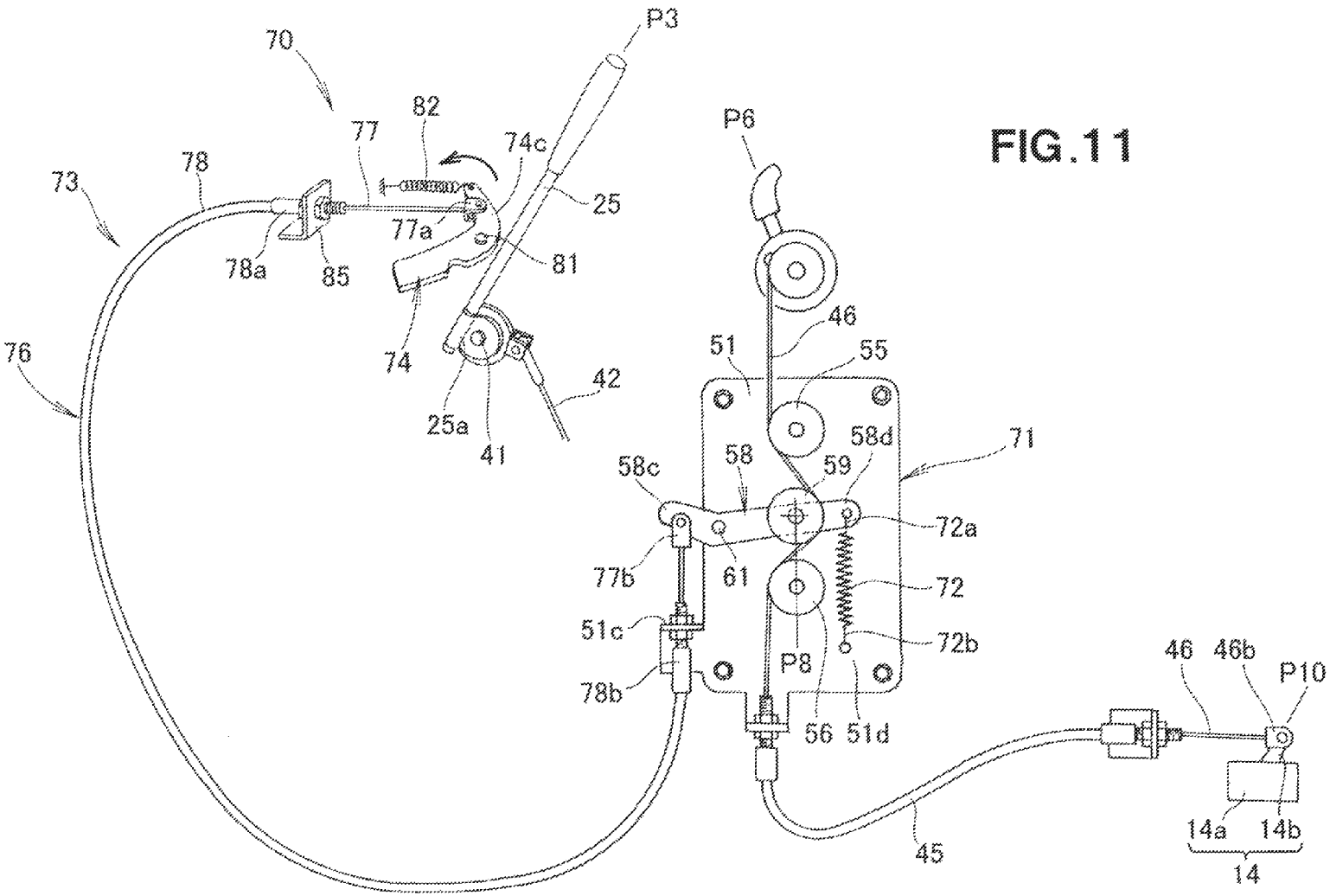
FIG. 11 is a side elevation view of portions of a working machine in a second embodiment of the present invention, the portions corresponding to those drown in FIG. 5.

Referring to FIG. 11, the work machine 70 in the second embodiment differs from the working machine 10 in that the working machine 10 includes a control mechanism 71 having a pull spring (pulling means) 72 and connecting means 73 which is movable together with the shift lever (operating means) 25.

More specifically, the control mechanism 71 differs from the control mechanism 31 in that the pull spring 72 and the connecting means 73 are used in place of the return spring 63 and the connecting means 64.

The pull spring 72 has an upper hook 72*a* connected (locked) to the front end 58*d* of the arm portion 58, and a lower hook 72*b* connected (locked) to the front lower portion 51*d* of the support plate 51. The arm portion 58 is urged by a spring force of the pull spring 72 in such a manner as to turn clockwise on the support pin 61. The pressing roller 59 is held by the spring force of the pull spring 72 in the tightening position P8 between the upper and lower guide rollers 55, 56 unless a connecting cable 76 of the connecting means 73 is pulled by the shift lever 25, as will be discussed later.

The connecting means 73 includes a curved arm 74 disposed on a mounting bracket (not shown). The mounting bracket is disposed on a cross member (not shown) interconnecting and extending between the left and right operational rods 21, 22. The connecting cable 76 of the connecting means 73 interconnects the curved arm 74 and the arm portion 58.

Figure 13A:
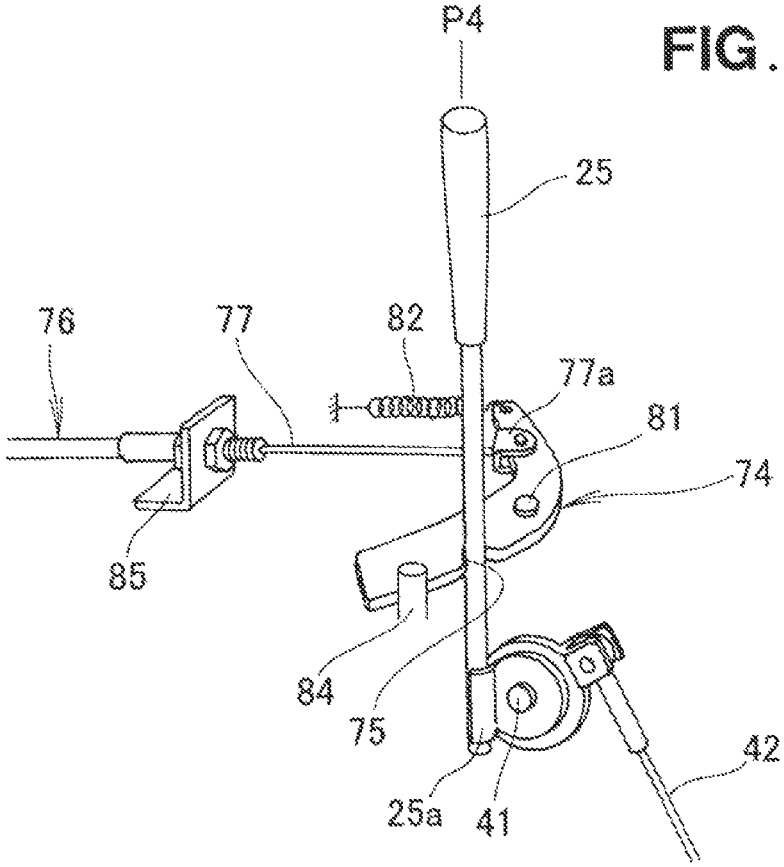
FIG. 13A is a perspective view of the control mechanism of the working machine of FIG. 11 with the shift lever of FIG. 11 set in a neutral position and FIG. 13B is a plan view of the control mechanism of FIG. 13A with the shift lever of FIG. 11 set in the neutral position.
Figure 13B:
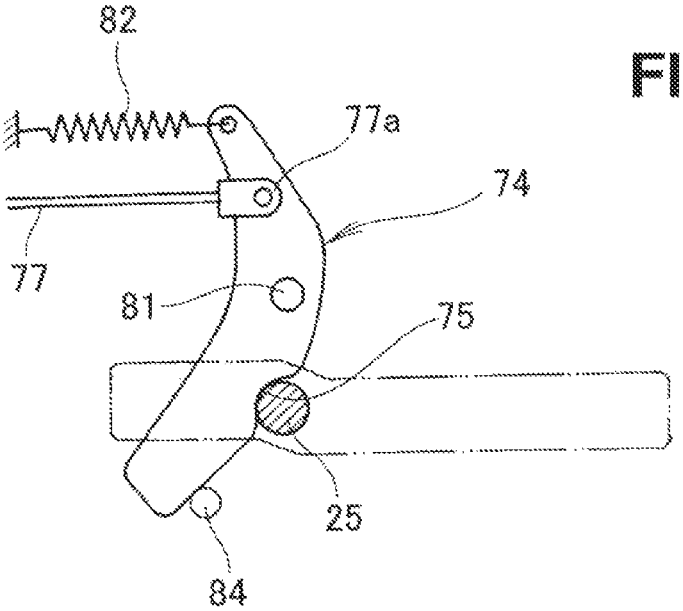
Figure 14A:
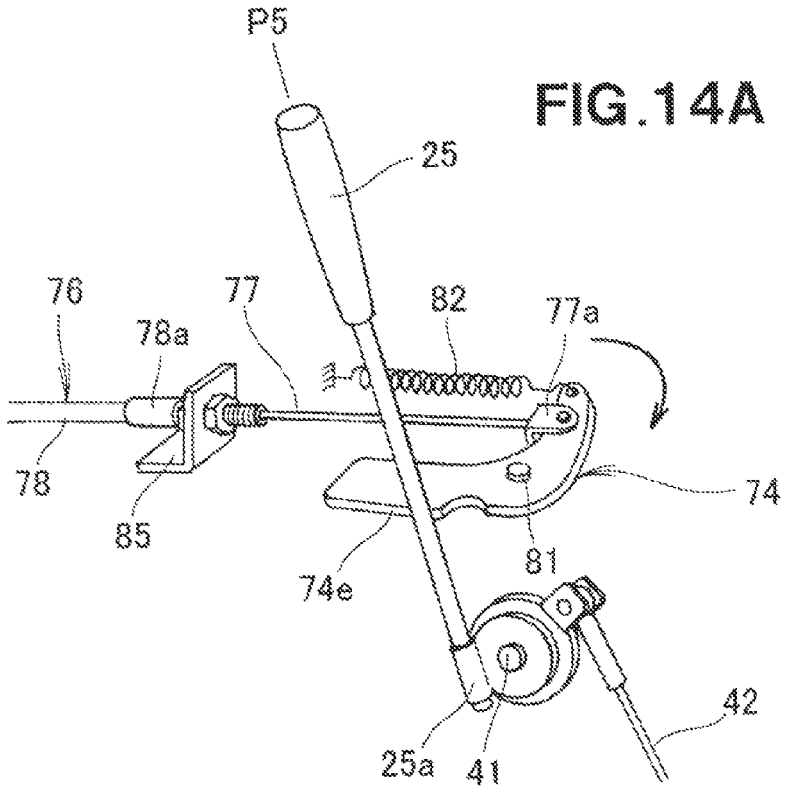
FIG. 14A is a perspective view of the control mechanism of the working machine of FIG. 11 with the shift lever of FIG. 11 set in a reverse travel position and FIG. 14B is a plan view of the control mechanism of FIG. 14A with the shift lever of FIG. 11 set in the reverse travel position.
Figure 14B:
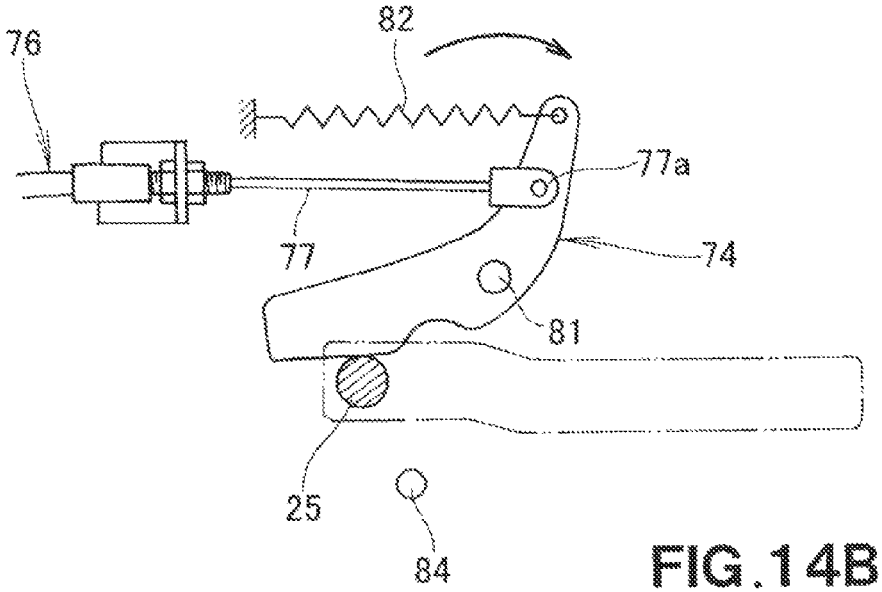

As shown in FIGS. 12A and 12B, the curved arm 74 is arcuate-shaped and includes a forward curved middle portion 74*a* supported by the mounting bracket through a support pin 81 in such a manner as to allow the curved arm 74 to pivot on the support pin 81. The curved arm 74 has a connection portion 74*c* connected to a proximal end 77*a* of an inner cable of the connecting cable 76. The connection portion 74*c* is located between the middle portion 74*a* and a left end 74*b* of the curved arm 74. The left end 74*b* of the curved arm 74 is connected (locked) to a front hook 82*a* of a return spring 82. The return spring 82 has a rear hook 82*b* connected (locked) to, for example, a mounting bracket 83 disposed on a cross member interconnecting and extending between the left and right operational rods 21, 22. The left end 74*b* of the curved arm 74 is pulled rearward by the return spring 82. The curved arm 74 also includes a recess 75 located between the middle portion 74*a* and a right end 74*d* of the curved arm 74. The recess 75 is adapted to receive the shift lever 25 when the shift lever 25 is in the neutral position P4, as shown in FIGS. 13A and 13B. When the shift lever 25 is switched to the forward travel position P3, as shown in FIGS. 12A and 12B, the shift lever gets away from the curved arm 74. With the shift lever being away from the curved arm 74, the right end 74*d* of the curved arm 74 abuts on a stopper pin 84, thereby keeping the curved arm 74 oriented laterally. When the shift lever 25 is switched to the reverse travel position P5, as shown in FIGS. 14A and 14B, a right pressed portion 74*e* of the curved arm 74 is pressed by the shift lever 25, such that the curved arm 74 turns on the support pin 81 in a direction of an arrow so as to pull the inner cable 77 of the connecting cable 76 forward.

As shown in FIG. 11, the inner cable 77 of the connecting cable 76 interconnects the connection portion 74*c* of the curved arm 74 and the rear end 58*c* of the arm portion 58. The connecting cable 76 includes an outer tube 78 through which the inner cable 76 is slidably inserted. The inner cable 76 has a proximal end 77*a* connected to the connection portion 74*c* of the curved arm 74, and a distal end 77*b* connected to the rear end 58*c* of the arm portion 58. The outer tube 78 has a proximal end 78*a* attached to a mounting bracket 85, and a distal end 78*b* attached to the rear lower end 51*c* of the support plate 51.

Figure 15:
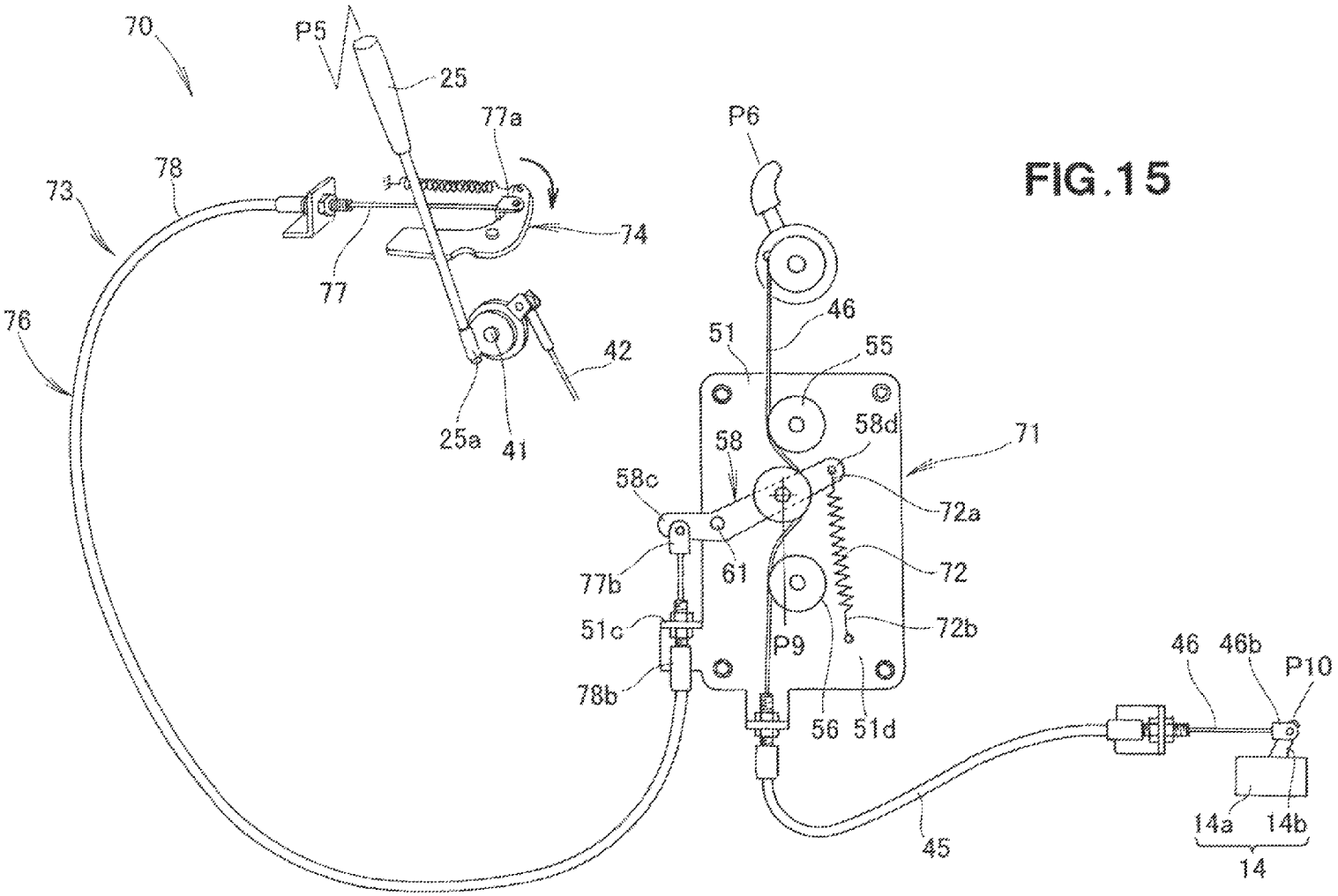
FIG. 15 is a view showing how to slacken the throttle cable, using the shift lever of FIG. 11.

When the shift lever 25 is switched to the reverse travel position P5, as shown in FIG. 15, the curved arm 74 turns in a direction of an arrow to pull the connecting cable 76 (the inner cable 77) forward. The forward pull on the inner cable 77 moves the distal end 77*b* of the inner cable 77 downward. This downward movement of the distal end 77*b* of the inner cable 77 turns the arm portion 58 counterclockwise, such that the pressing roller 59 moves upward and backward to the slackening position P9 between the upper and lower guide rollers 55, 56. In the slackening position P9, the pressing roller 59 slackens the throttle cable 45 (the inner cable 46) without pressing the inner cable 46 against the upper and lower guide rollers 55, 56. With the pressing roller 59 set in the slackening position P9, the inner cable 46 is held slack.

When the shift lever 25 is switched to the neutral position P4 (FIG. 13) or the forward travel position P3, the curved arm 74 turns in a direction of an arrow under the spring force of the return spring 82, as shown in FIG. 11. This turning of the curved arm 74 releases the connecting cable 76 (the inner cable 7) from a forward pulled position discussed above. The releasing of the inner cable 77 from the forward pulled position allows the arm portion 58 to turn clockwise under the spring force of the pull spring 72. This clockwise turning of the arm portion 58 moves the pressing roller 59 downward and forward to the tightening position P8 between the upper and lower rollers 55, 56. In the tightening position P8, the pressing roller 59 presses the throttle cable 45 (the inner cable 46) against the upper and lower guide rollers 55, 56. With the pressing roller 59 set in the tightening position P8, thus, the inner cable 46 is held tight between the pressing roller 59 and the upper and lower guide rollers 55, 56.

Discussion is made with reference to FIGS. 16A to 17B as to how to increase a speed of the engine 13 to remove a large quantity of snow during forward traveling of the working machine 70.

Figure 16A:
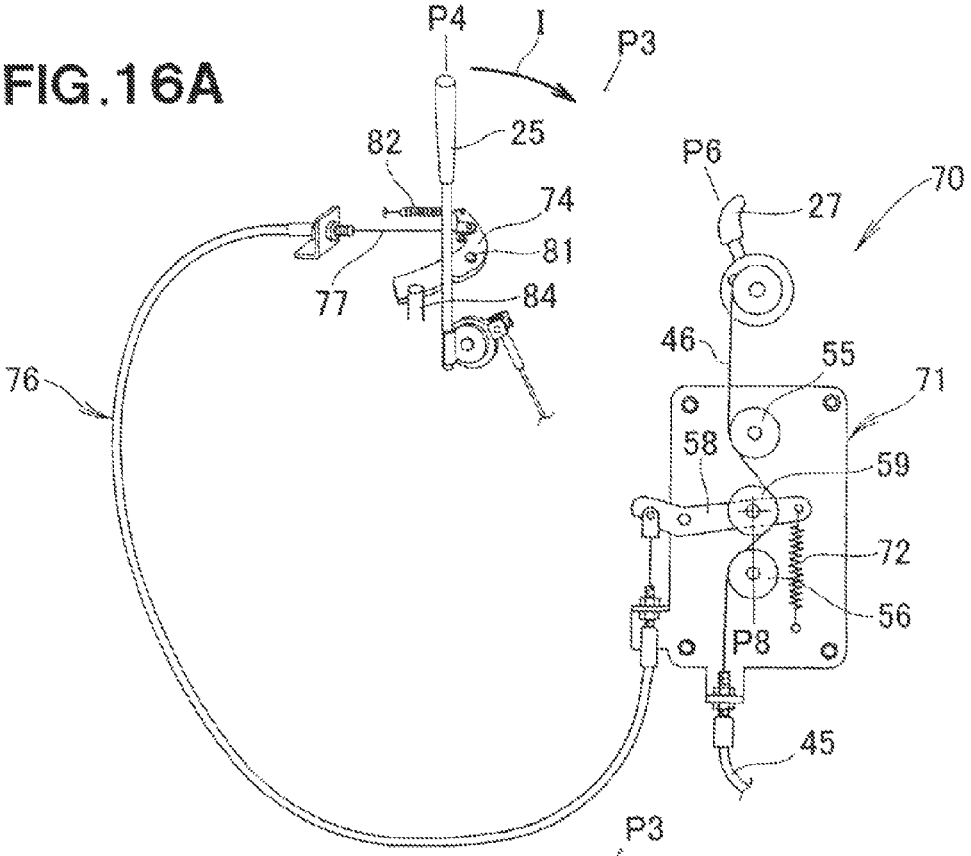
FIGS. 16A and 16B are views showing how to tighten the throttle cable, using the shift lever of FIG. 11.
Figure 16B:
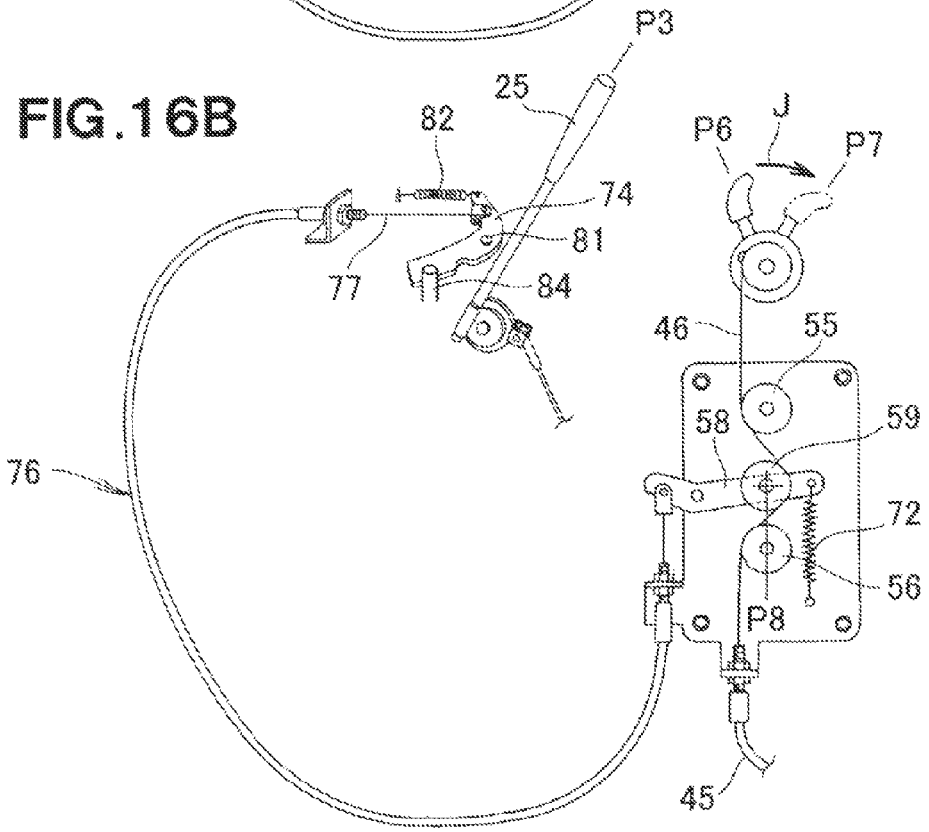

Referring to FIG. 16A, the curved arm 74 abuts on the stopper pin 84 under the spring force of the return spring 82 with the shift lever 25 set in the neutral position P4. Since the curved arm 74 does not pull the connecting cable 76 (the inner cable 77), the pressing roller 59 is held in the tightening position P8 by the spring force of the pull spring 72. With the pressing roller 59 set in the tightening position P8, the inner cable 46 of the throttle cable 45 is held tight. Then, the shift lever 25 is switched from the neutral position P4 to the forward travel position P3, as indicated by an arrow I.

By switching the shift lever 25 to the forward travel position P3, the transmission mechanism is switched to the forward travel mode in which the working machine 70 travels forward. During the forward traveling of the working machine 70 with the inner cable 46 being held tight by the pressing roller 59 in the tightening position P8, the throttle lever 27 moves from the low engine speed position P6 to the high engine speed position P7, as indicated by an arrow J.

Figure 17A:
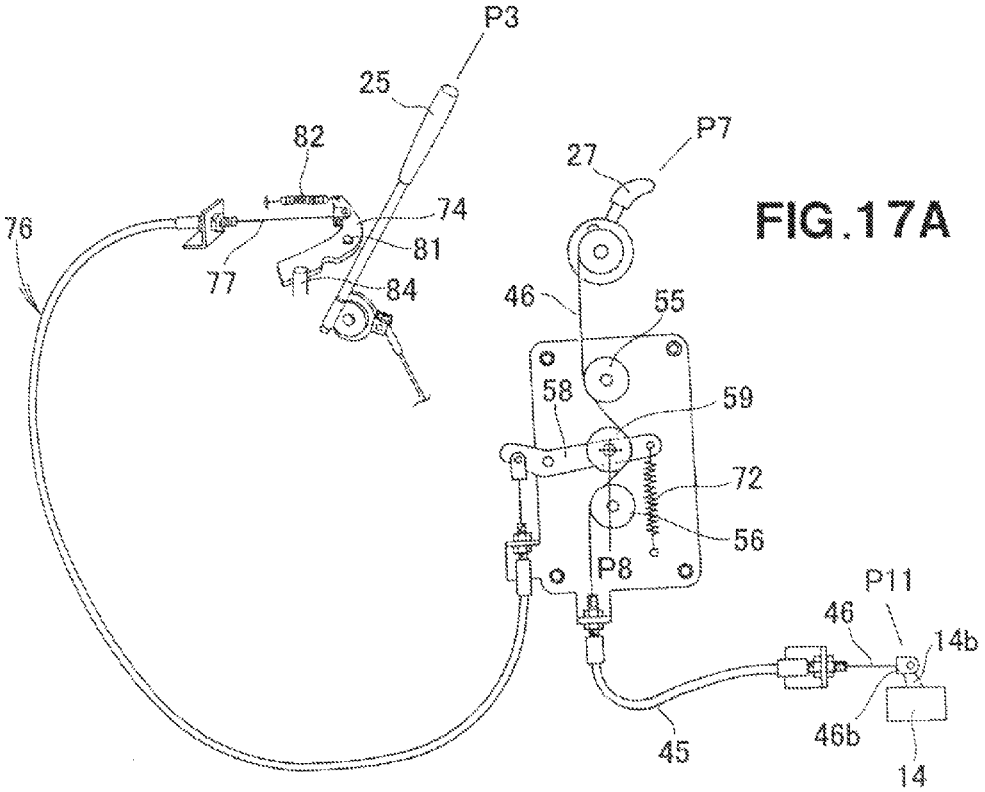
FIGS. 17A and 17B are views showing how to increase an engine speed with the shift lever set in the forward travel position to allow the working machine in the second embodiment to remove a large quantity of snow.

Since the pressing roller 59 in the tightening position P8 holds the inner cable 46 tight, as shown in FIG. 17A, the distal end 46*b* of the throttle cable 45 (the inner cable 46) is pulled backward by the movement of the throttle lever 27 to the high engine speed position P7. The backward pull on the distal end 46*b* of the inner cable 46 moves the throttle arm 14*b* of the throttle valve 14 to the high speed position P11, thereby adjusting a speed of the engine 13 to a high speed.

Figure 17B:
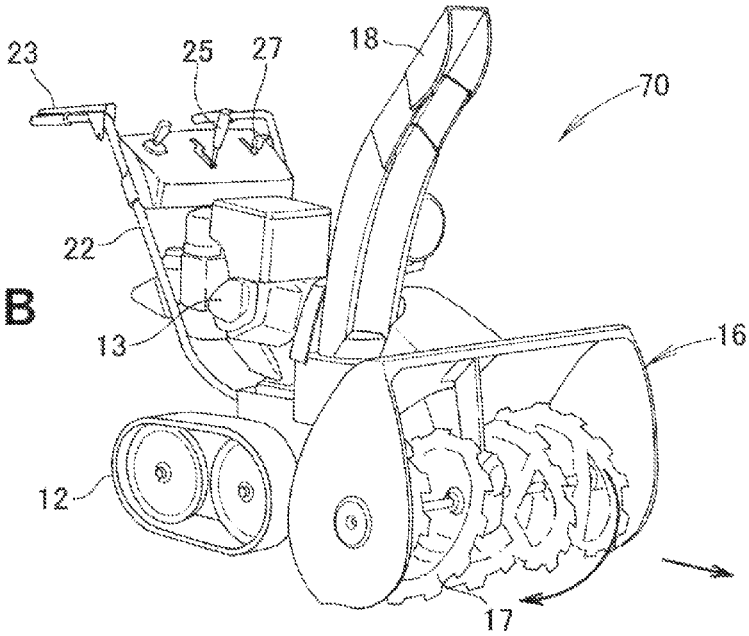

The adjustment of the speed of the engine 13 to the high speed causes the auger 17 and the blower (not shown) of the snow-removing mechanism 16 to operate at a high speed, as shown in FIG. 17B. During the forward traveling of the working machine 70, the auger 17 collects a large quantity of snow at its lateral center and the blower blows the collected snow upward out of the chute 18.

Figure 18A:
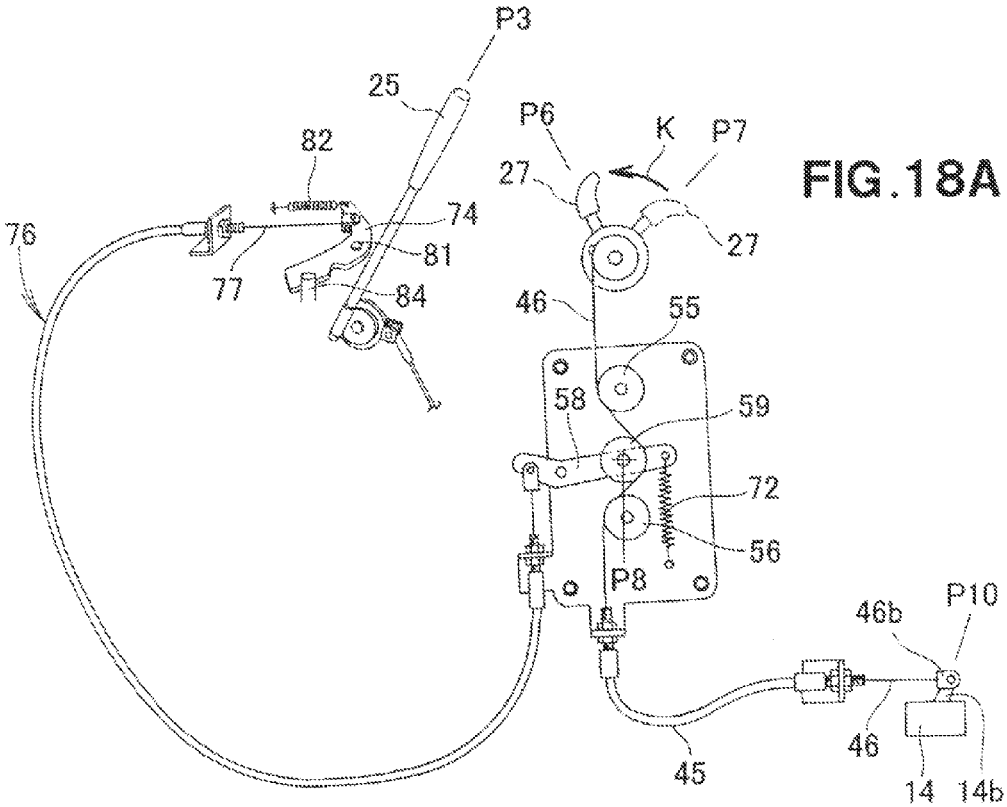
FIGS. 18A and 18B are views showing how to decrease the engine speed with the shift lever set in the forward travel position to allow the working machine in the second embodiment to remove a small quantity of snow.
Figure 18B:
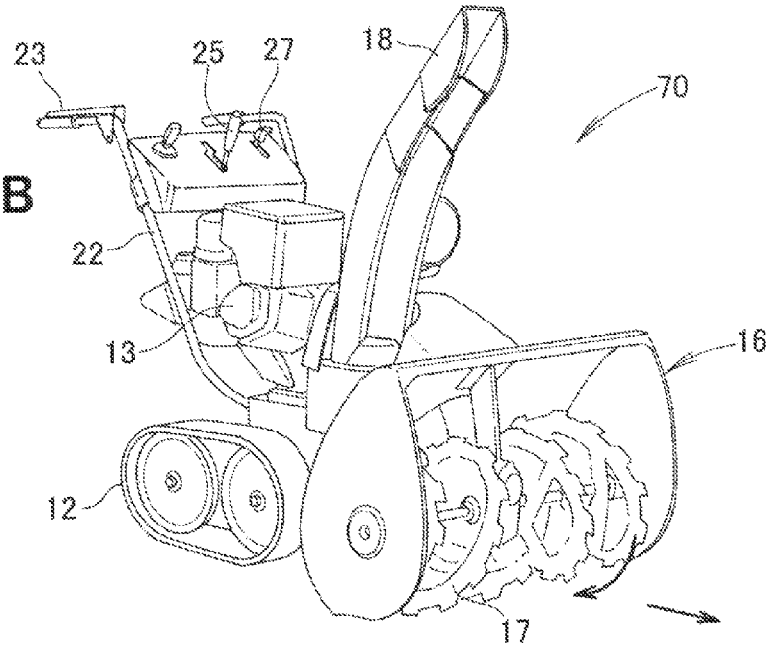

Discussion is made with reference to FIGS. 18A and 18B as to how to decrease a speed of the engine 13 to remove a small quantity of snow during forward traveling of the working machine 70.

As shown in FIG. 18A, the shift lever 25 is in the forward travel position P3 holding the pressing roller 59 in the tightening position P8 to hold the inner cable 46 of the throttle cable 45 tight. With the inner cable 46 being held in tight, the throttle lever 27 moves from the high engine speed position P7 to the low engine speed position P6, as indicated by an arrow K. This movement of the throttle lever 27 to the low Engine speed position P6 allows the throttle arm 14*b* of the throttle valve 14 to move to the low speed position P10 under the spring force of the return spring (not shown), thereby decreasing a speed of the engine 13.

By decreasing the speed of the engine 13, the auger 16 and the blower (not shown) of the snow-removing mechanism 16 operate at a reduced speed. During the forward traveling of the working machine 70 with the shift lever 25 set in the forward travel position P3, the auger 17 collects a small quantity of snow at its lateral center and the blower blows the collected snow upward out of the chute 18.

Figure 19A:
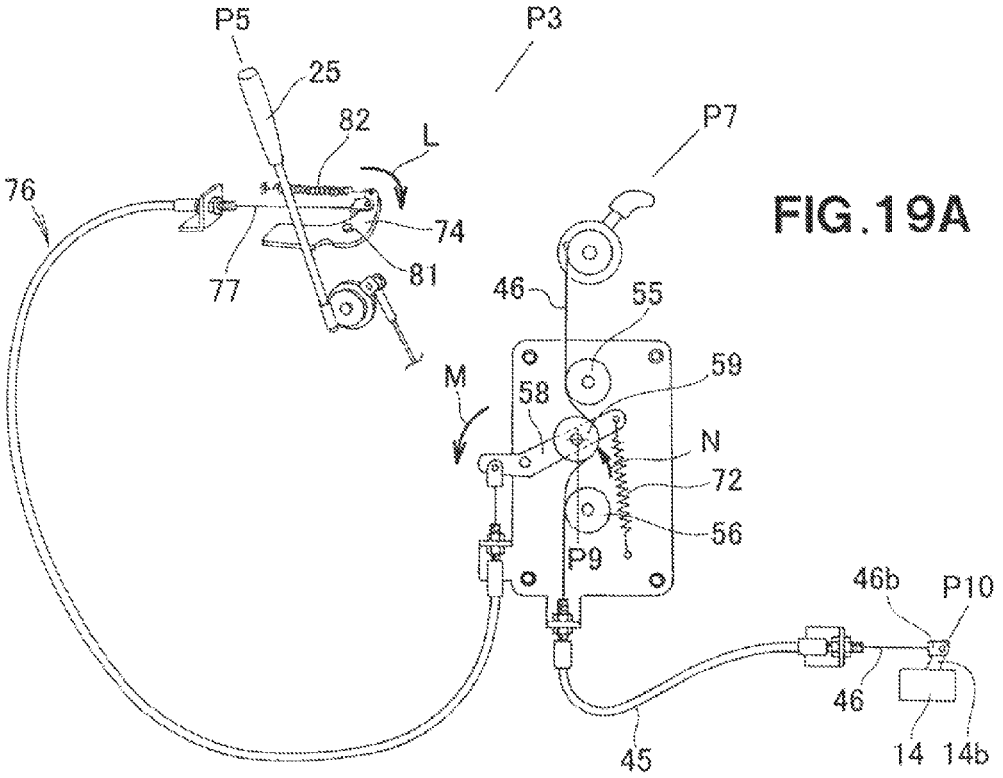
FIGS. 19A and 19B are views showing how to cause the working machine in the second embodiment to travel backward.
Figure 19B:
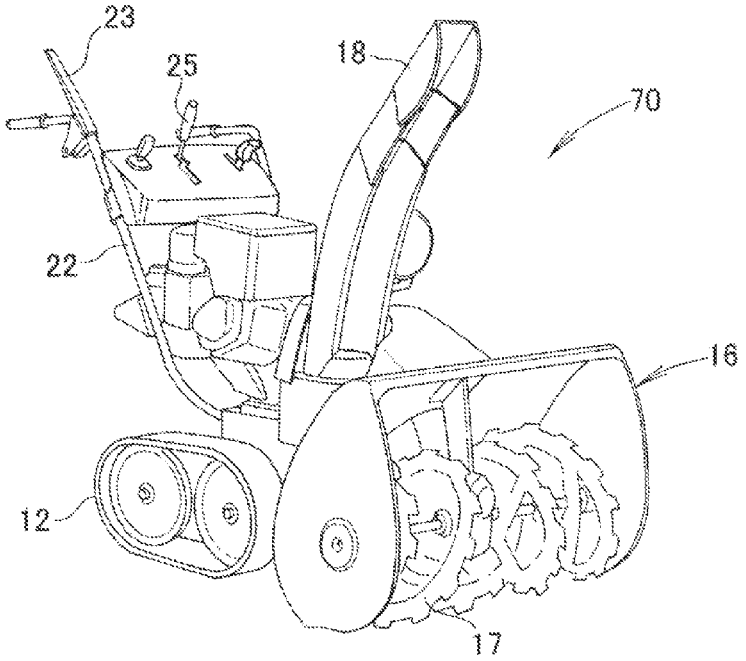

Discussion is made with reference to FIGS. 19A and 19B as to how to decrease a speed of the engine 13 during reverse traveling of the working machine 70.

Referring to FIG. 19A, the shift lever 25 is switched to the reverse travel position (non-operated position) P5 with the throttle lever 27 set in the high engine speed position P7. At this time, the curved arm 74 is pressed by the shift lever 25 to turn as indicated by an arrow L, thereby pulling the connecting cable 76 (the inner cable 77) forward. This forward pull on the inner cable 77 causes the arm portion 58 to turn counterclockwise as indicated by an arrow M. The counterclockwise turning of the arm portion 58 moves the pressing roller 59 to the slackening position P9, as indicated by an arrow N, to slacken the inner cable 46 of the throttle cable 45. With the inner cable 46 slackened, the throttle arm 14*b* of the throttle valve 14 is forced by the spring force of the return spring (not shown) to return to the low speed position P10 to decrease a speed of the engine 13.

From the foregoing, that is, the speed of the engine 13 can be automatically decreased by switching the shift lever 25 to the reverse travel position P5.

By decreasing the speed of the engine 13, the auger 17 and the blower (not shown) of the snow-removing mechanism 16 operate at a reduced speed and the working machine 70 travels backward, as shown in FIG. 19B. Thereafter, the shift lever 25 is switched from the reverse travel position P5 to the forward travel position (operated position) P3 in order to switch the backward traveling of the working machine 70 to the forward traveling of the working machine 70. By thus switching the shift lever 25 to the forward travel position P3, the pressing roller 59 is allowed to move back to the tightening position P8 (FIG. 18A) to tighten the inner cable 46 of the throttle cable 45.

By switching the inner cable 46 from the slack position to the tight position with the throttle lever 27 set in the high engine speed position P7, the distal end 46*b* of the throttle cable 45 (the inner cable 46) is pulled backward to thereby move throttle arm 14*b* of the throttle valve 14 to the high speed position P11 to provide a high speed of the engine 13.

From the foregoing, that is, the speed of the engine 13 can be automatically adjusted to the high speed by switching the shift lever 25 to the forward travel position P3. With the speed of the engine 13 being adjusted to the high speed, the auger 17 and the blower (not shown) of the snow-removing mechanism 16 operate at a high speed. During the forward traveling of the worming machine 70 with the shift lever 25 set in the forward travel position P3, the auger 17 collects a large quantity of snow at its lateral center and the blower blows the collected snow upward out of the chute 18.

As discussed above, the working machine 70 in the second embodiment is designed such that the connecting means 74 is moved by the shift lever 25. By switching the shift lever 25 from one of the forward travel position (operated position) P3 and the neutral position P4 to the reverse travel position (non-operated position) P5 or vice versa, the pressing roller 59 moves between the tightening position P8 and the slackening position P9. By thus switching the pressing roller 59 to the slackening position P9 or the tightening position P8, the speed of the engine 13 can be adjusted between the low speed and the high speed. That is, by switching the shift lever 25 to the operated position or the non-operated position, the speed of the engine 13 can be automatically adjusted between the low speed and the high speed. Furthermore, a mechanism for automatically adjusting an engine speed to a high or low speed is formed by only mechanism components including the connecting means the upper and lower guide rollers 55, 56, the throttle cable tightening/loosening means 57, the pull spring 72. In other words, the mechanism for adjusting an engine speed can be made without using electrical components, which leads to cost reduction.

Figure 20:
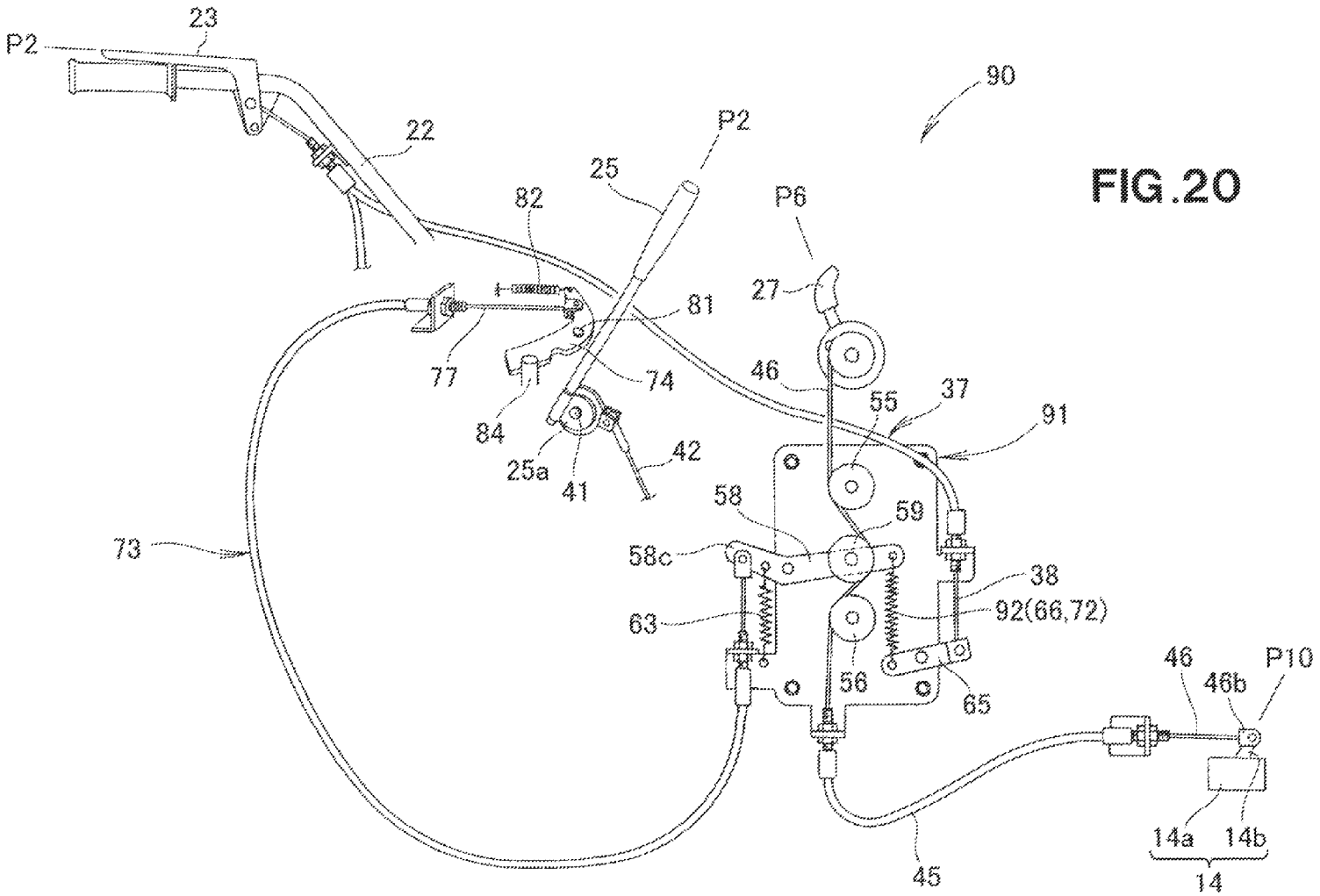
FIG. 20 is a side elevation view of portions of a working machine in a third embodiment of the present invention, the portions corresponding to those shown in FIG. 5.

Referring to FIG. 20, the working machine 90 in the third embodiment differs from the working machine 10 in that the working machine 90 includes a control mechanism 91 movable together with the clutch lever 23 and the shift lever 25.

More specifically, the control mechanism 91 differs from the control mechanism 31 of the working machine 10 in that the control mechanism 91 is the control mechanism 31 (with the rear end 58*c* of the arm portion 58) connected to the connecting means 73 in the second embodiment. The control mechanism 91 includes a connecting/pull spring 92 acting as urging means serving as both the connecting spring 66 in the first embodiment and the pull spring 72 in the second embodiment. That is, the spring 92 acts in the same manner as the connecting spring 66 when the arm portion 58 is controlled by the clutch lever 23 while the spring 92 acts in the same manner as the pull spring the arm portion 58 is controlled by the shift lever 25, as discussed below.

Figure 21A:
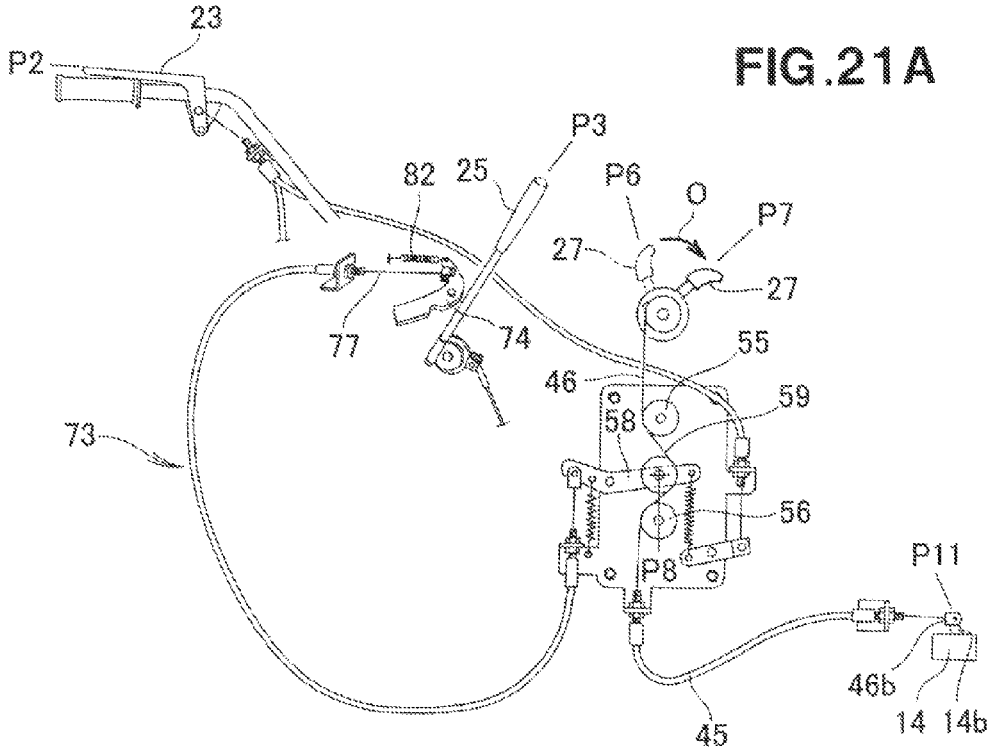
FIG. 21A is a view showing how to increase an engine speed with a clutch lever set in a clutch engaged position to allow the working machine in the third embodiment to remove a large quantity of snow and FIG. 21B is view showing how to decrease the engine speed with the clutch lever set in a clutch disengaged position to allow the working machine in the third embodiment to remove a small quantity of snow.

Discussion is made with reference to FIG. 21A as to how to increase a speed of the engine 13 to remove a large quantity of snow during forward traveling of the working machine 90.

The shift lever 25 is switched to the forward travel position (operated position) P3 and the clutch lever 23 is switched to the clutch engaged position (operated position) P2, as shown in FIG. 21A. This moves the pressing roller 59 to the tightening position P8 to tighten the throttle cable 45 (the inner cable 46). With the inner cable 46 being tightened by the pressing roller 59 in the tightening position P8, the throttle lever 27 moves from the low engine speed position P6 to the high engine speed position P7, as indicated by an arrow O. This movement of the throttle lever 27 to the high engine speed position P7 pulls the distal end 46*b* of the throttle cable 45 (the inner cable 46) backward. The backward pull on the distal end 46*b* moves the throttle arm 14*b* of the throttle valve 14 to the high speed position P11 to adjust a speed of the engine 13 to a high speed.

By adjusting the speed of the engine 13 to the high speed, the auger 17 and the blower (not shown) of the snow-removing mechanism 16 operate at a high speed. During the forward traveling of the working machine 90 with the shift lever 25 set in the forward travel position P3, the auger 17 collects a large quantity of snow at its lateral center and the blower blows the collected snow upward out of the chute 18.

Figure 21B:
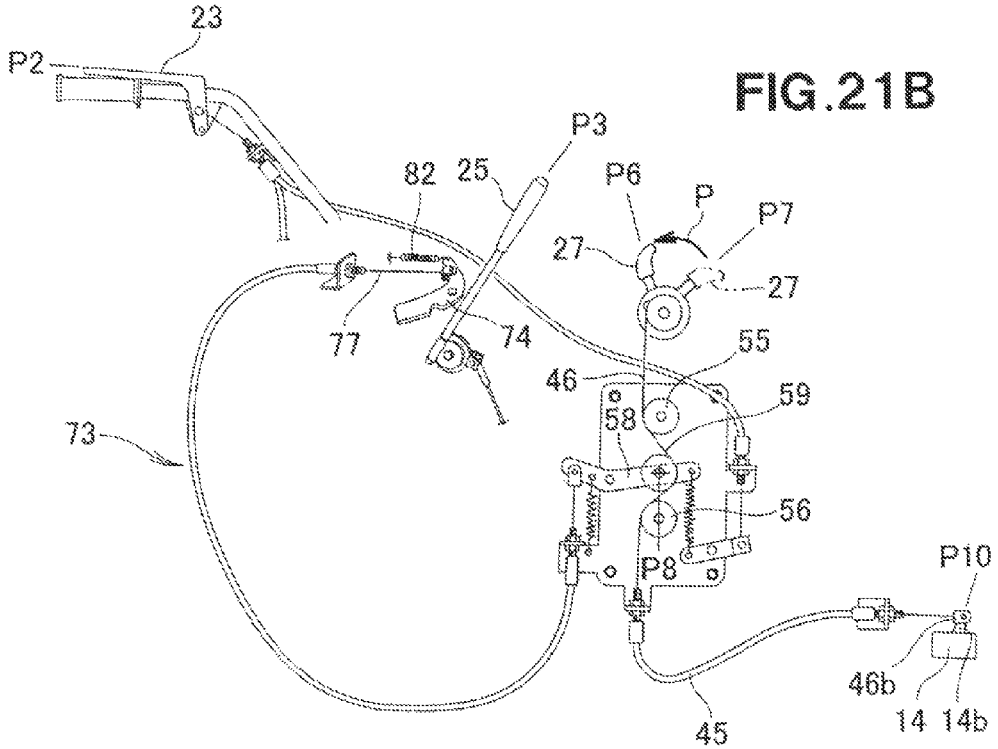

Discussion is made with reference to FIG. 21B as to how to decrease a speed of the engine 13 to remove a small quantity of snow during forward traveling of the working machine 90.

The shift lever 25 is switched to the forward travel position P3 while the clutch lever 23 is switched to the clutch engaged position P2, as shown in FIG. 21B. This moves the pressing roller 59 to the tightening position P8 to tighten the throttle cable 45 (the inner cable 46). With the inner cable 46 being tightened by the pressing roller 59 in the tightening position P8, the throttle lever 27 moves from the high engine speed position P7 to the low engine speed position P6, as indicated by an arrow P. This movement of the throttle lever 27 to the low engine speed position P6 allows the throttle arm 14*b* of the throttle valve 14 to move to the low speed position P10 under the spring force of the return spring (not shown), thereby decreasing a speed of the engine 13.

By decreasing the speed of the engine 13, the auger 17 and the blower (not shown) of the snow-removing mechanism 16 operate at a reduced speed. During forward traveling of the working machine 90 with the shift lever 25 set in the forward travel position P3, the auger 17 collects a small quantity of snow at its lateral center and the blower blows the collected snow upward out of the chute 18.

Figure 22A:
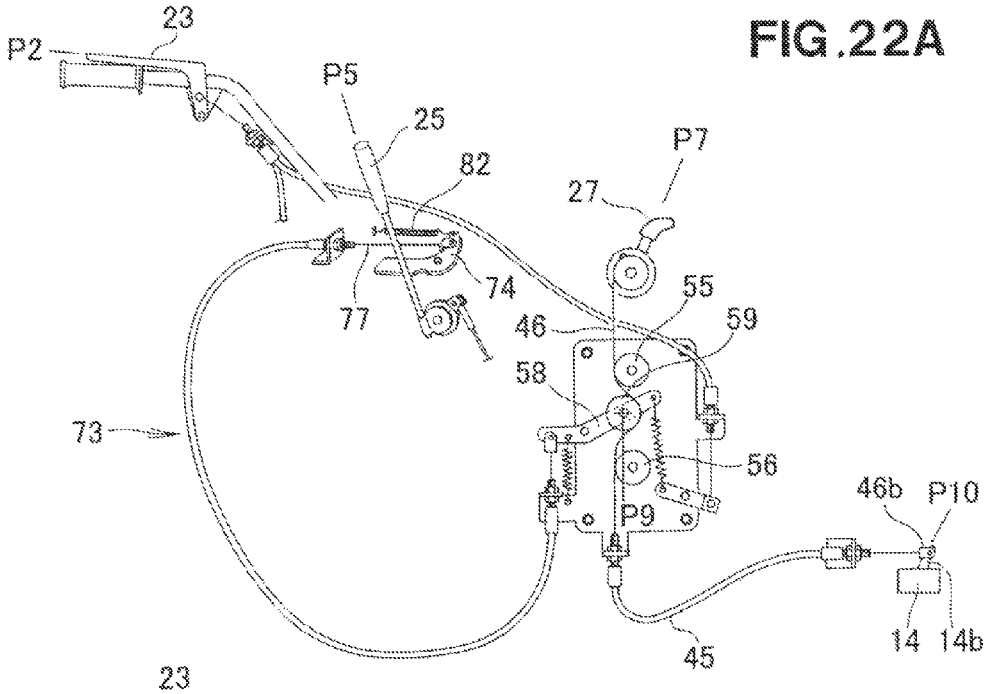
FIG. 22A is a view showing how to cause the working machine in the third embodiment to travel backward and FIG. 22B is a view showing how to stop forward traveling of the working machine in the third embodiment.

Discussion is made with reference to FIG. 22A as to reverse traveling of the working machine 90.

The shift lever 25 is switched to the reverse travel position (non-operated position) P5 and the clutch lever 23 is switched to the clutch engaged position P2, as shown in FIG. 22A. This moves the pressing roller 59 to the slackening position P9 to slacken the inner cable 46 of the throttle cable 45, thereby allowing the throttle arm 14*b* of the throttle valve 14 to move back to the low speed position P10 under the spring fore of the return spring (not shown). With the throttle arm 14*b* set in the low speed position P10, thus, a speed of the engine 13 is decreased.

By switching the shift lever 25 to the reverse travel position P5, that is, the speed of the engine 13 can be automatically decreased. As a result, the auger 17 and the blower (not shown) operate at a reduced speed during the reverse traveling of the working machine 90.

Figure 22B:
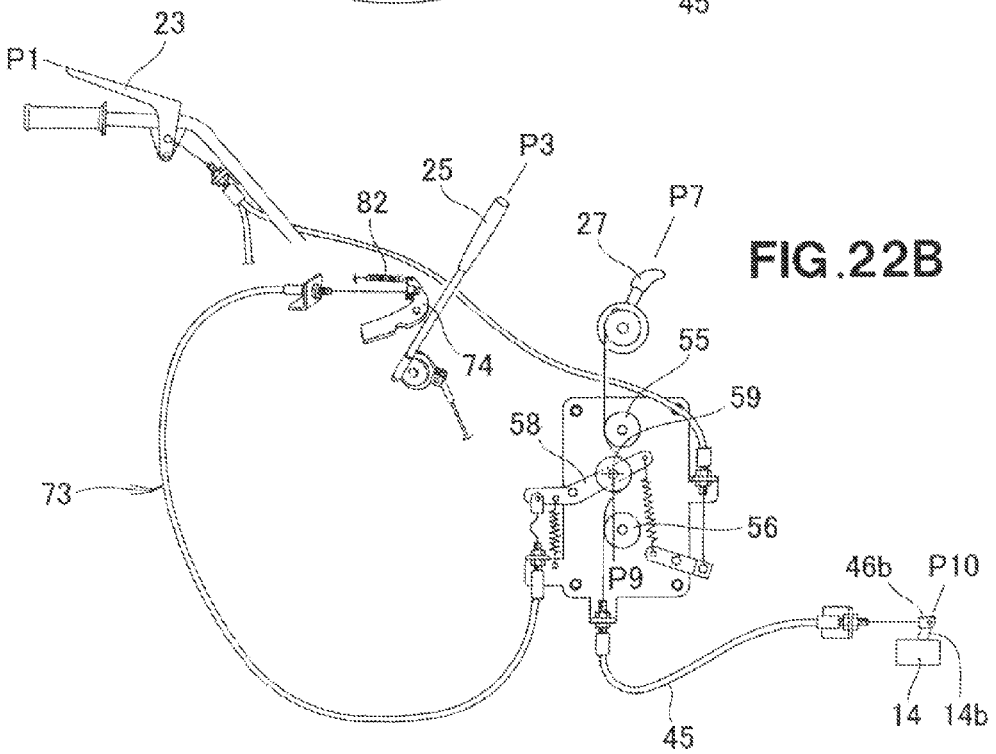

Discussion is made with reference to FIG. 22B as to how to stop forward traveling of the working machine 90.

The clutch lever 23 is switched to the clutch disengaged position (non-operated position) P1 with the shift lever 25 set in the forward travel position (operated position) P3, as shown in FIG. 22B. This allows the pressing roller 59 to move to the slackening position P9 under the force of the return spring 63, thereby slackening the inner cable 46 of the throttle cable 45. The throttle arm 14*b* of the throttle valve 14 is then forced by the spring force of the return spring (not shown) to move back to the low speed position P10 to decrease a speed of the engine 13.

By switching the clutch lever 23 to the clutch disengaged position P1, that is, the speed of the engine 13 can be automatically decreased. By switching the clutch lever 23 to the clutch disengaged position P1, also, the working machine 90 stops traveling.

Figure 23:
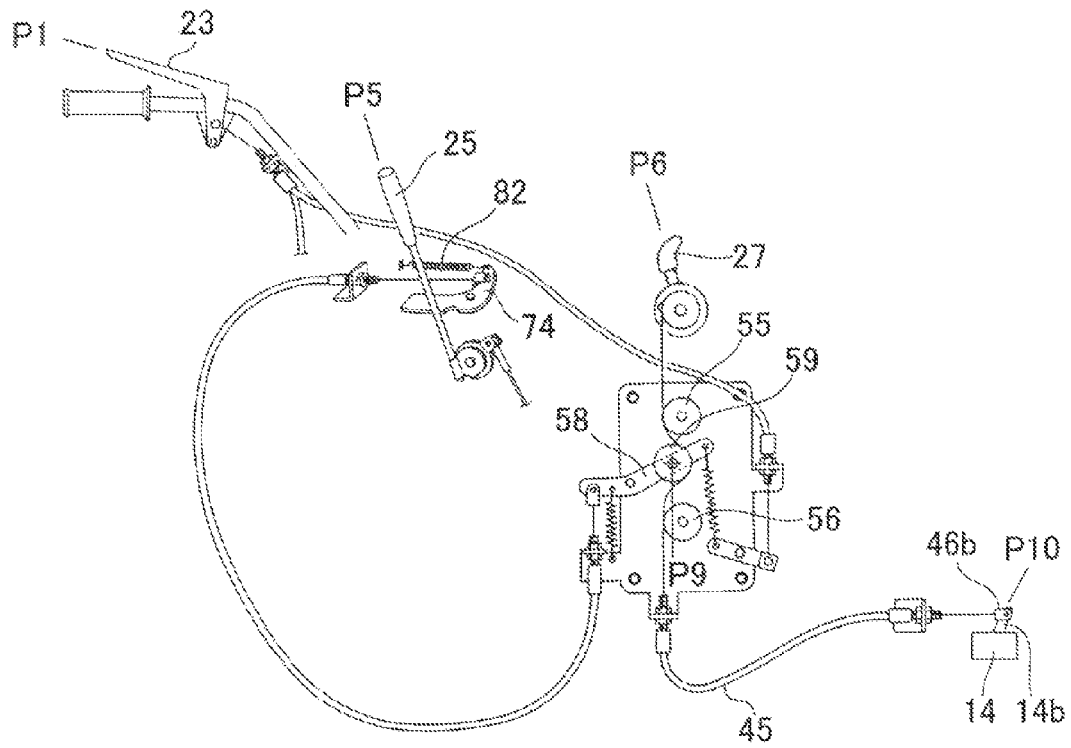
FIG. 23 is a view showing the clutch lever, a shift lever and a throttle lever of the working machine in the third embodiment, the clutch, shift and throttle levers being operated to decrease the engine speed.

Discussion is made with reference to FIG. 23 as to operation of the three levers, the clutch lever 23, the shift lever 25 and the throttle lever 27, for decreasing a speed of the engine 13.

By setting the throttle lever 27 in the low engine speed position P6, as shown in FIG. 23, the throttle arm 14*b* of the throttle valve 14 moves to the low speed position P10 under the spring force of the return spring (now shown), thereby decreasing a speed of the engine 13. Then, the shift lever 25 is switched to the reverse travel position P5 and the clutch lever 23 is switched to the clutch disengaged position P1. This moves the pressing roller 59 to the slackening position P9 to slacken the inner cable 46 of the throttle cable 45. As a result, the speed of the engine 13 can be kept at a reduced speed.

In the working machine 90 in the third embodiment, as discussed above, by switching the clutch lever 23 or the shift lever 25 to the operated position or the non-operated position, the speed of the engine 13 can be automatically adjusted between the low speed and the high speed. Furthermore, the working machine 90 can effect cost reduction like the working machines 10, 70 in the first and second embodiments.

Figure 24:
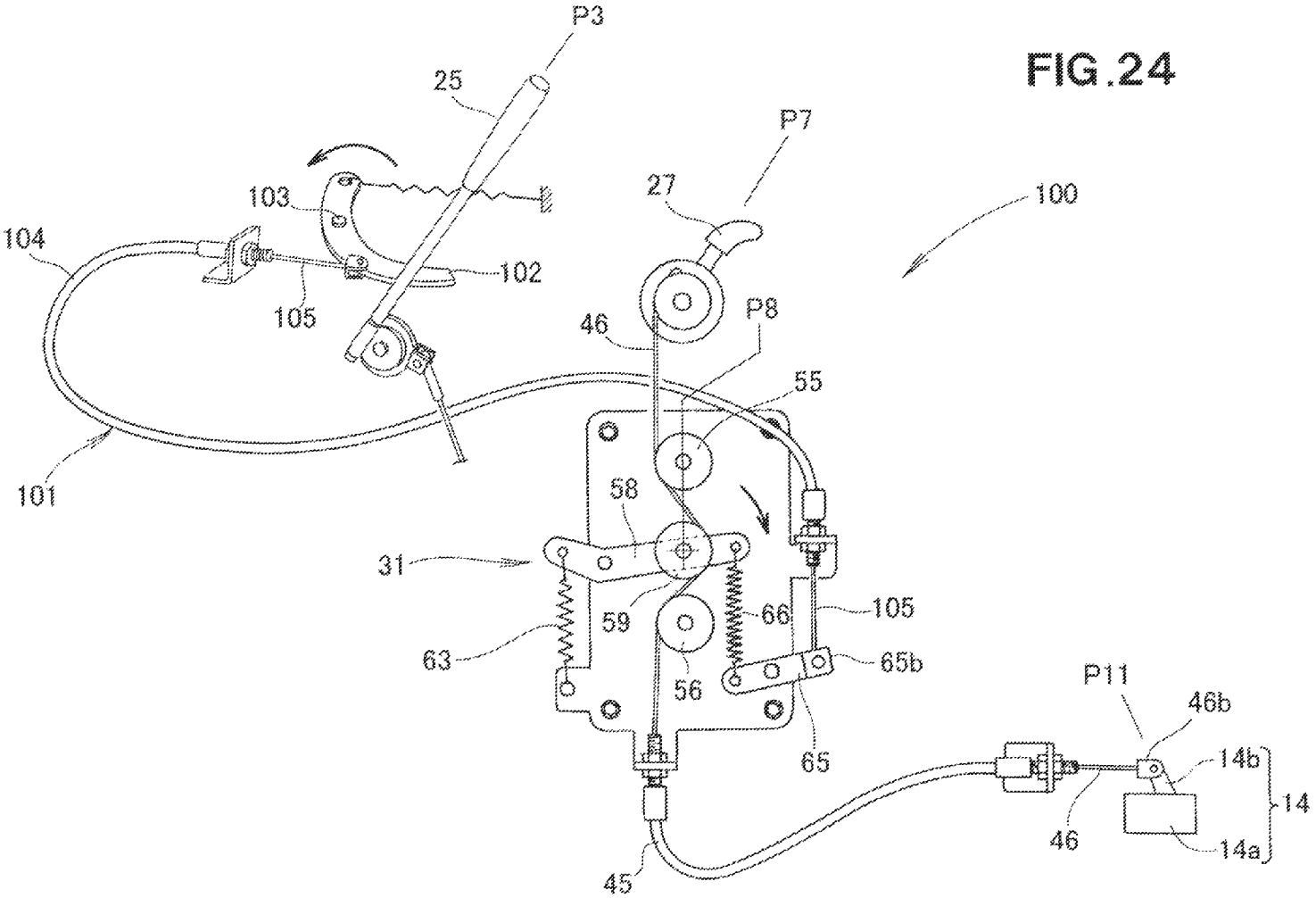
FIG. 24 is a side elevation view of portions of a working machine in a fourth embodiment of the present invention, the portions corresponding to those shown in FIG. 5.

Referring to FIG. 24, the working machine 100 in the fourth embodiment differs from the working machine 10 in that the working machine 100 includes connecting means 101 used in place of the second clutch cable 37. More specifically, the connecting means 101 includes a curved arm 102 connected through a support pin 103 to a mounting bracket (not shown), and a connecting cable 104 interconnecting the curved arm 102 and the pulling arm 65. The mounting bracket is disposed on a cross member (not shown) interconnecting and extending between the left and right operational rods 21, 22. The curved arm 102 is connected to the pulling arm 65 through an inner cable 105 of the connecting cable 104.

When the shift lever 25 is switched to the forward travel position (operated position) P3, the curved arm 102 is pressed by the shift lever 25 to move as indicated by an arrow. This movement of the curved arm 102 pulls the inner cable 105, thereby pulling upward the front end 65*b* of the pulling arm 65. This upward pull on the front end 65*b* causes the pulling arm 65 to turn counterclockwise. The counterclockwise turning of the pulling arm 65 causes the connecting spring 66 to exert a spring force on the arm portion 58 to turn the arm portion 58 clockwise (in a direction of an arrow), thereby moving the pressing roller 59 to the tightening position P8 to tighten the inner cable 46.

Since the throttle lever 27 is in the high engine speed position P7 with the inner cable 46 being tightened by the pressing roller 59, the distal end 46*h* of the inner cable 46 is pulled backward to move the throttle arm 14*b* of the throttle valve 14 to the high speed position P11, such that a speed of the engine 13 is automatically increased to a high speed.

Figure 25:
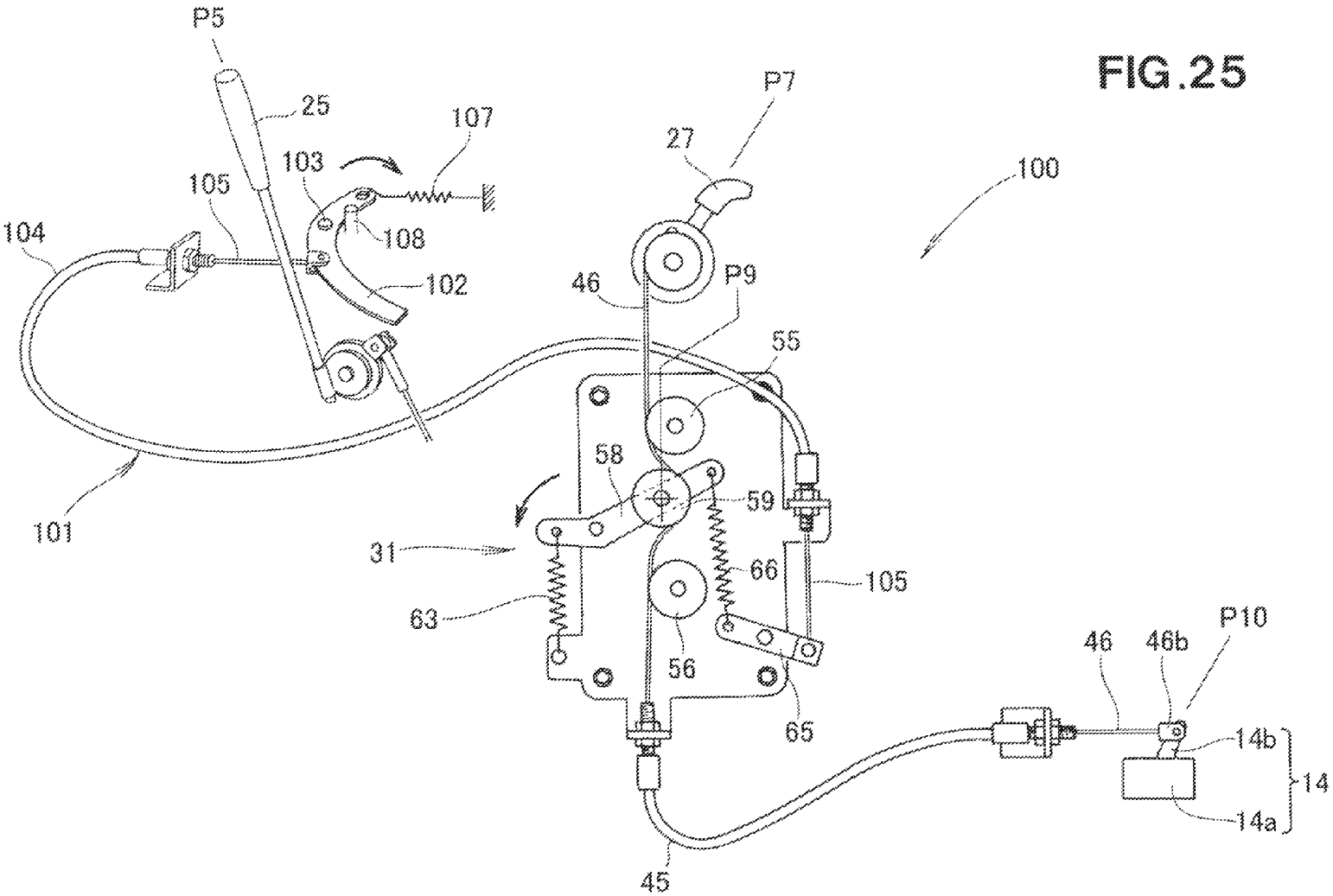
FIG. 25 is a view showing how to slacken a throttle cable of the working machine of FIG. 24.

The shift lever 25 is then switched to the reverse travel position (non-operated position) P5, as shown in FIG. 25. This allows the curved arm 102 to move, as indicated by an arrow, into abutment on a stopper pin 108 under a spring force of a return spring 107. Upon the movement of the curved arm 102 into abutment on the stopper pin 108, the inner cable 105 stops pulling the pulling arm 65, thereby allowing the arm portion 58 to turn counterclockwise (in a direction of an arrow) under the spring force of the return spring 63. As a result of the counterclockwise turning of the arm portion 58, the pressing roller 59 moves to the slackening position P9 to slacken the inner cable 46. This allows the throttle arm 14*b* of the throttle valve 14 to move back to the low speed position P10 under the spring force of the return spring (not shown), thereby decreasing the speed of the engine 13.

By switching the shift lever 25 to the reverse travel position P5, that is, the speed of the engine 13 can be automatically decreased.

In the working machine 100 in the fourth embodiment, as discussed above, by switching the shift lever 25 to the operated position or the non-operated position, the speed of the engine 13 can be automatically adjusted between the low speed and the high speed. Furthermore, the working machine 100 can effect cost reduction like the working machines 10, 70 in the first and second embodiments.

Figure 26:
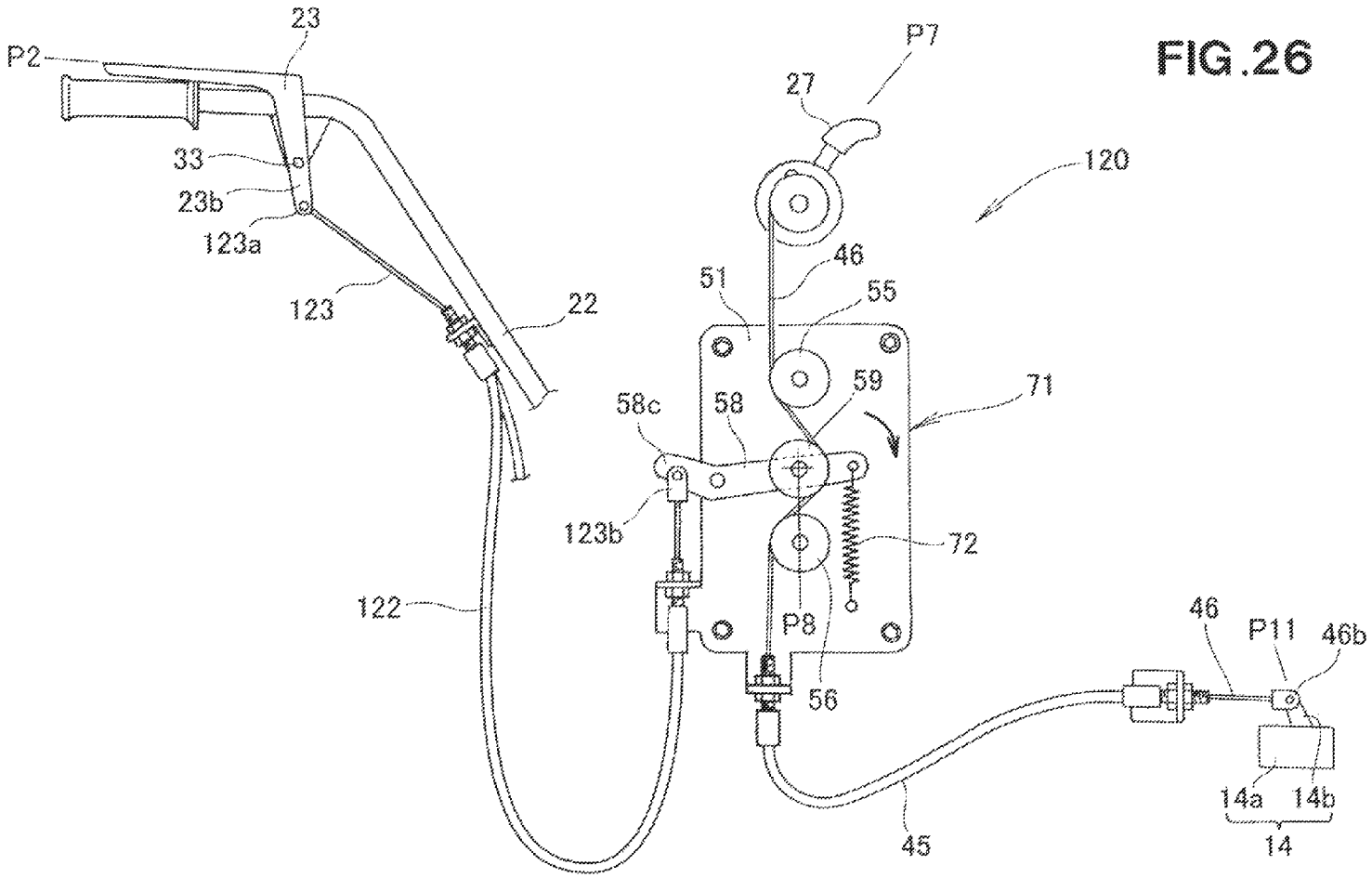
FIG. 26 is a side elevation view of portions of a working machine in a fifth embodiment of the present invention, the portions corresponding to those shown in FIG. 5.

Referring to FIG. 26, the working machine 120 in the fifth embodiment differs from the working machine 70 in that the control mechanism 71 uses a second clutch cable 122 in place of the connecting means 73. More specifically, the second clutch cable 122 includes an inner cable 123 having a proximal end 123*a* connected to a base arm 23*h* of the clutch lever 23 and a distal end 123*b* connected to the rear end 58*c* of the arm portion 58.

The inner cable 123 is adapted to be released from a pulled position when the clutch lever 23 is switched to the clutch engaged position (operated position) P2. Upon the releasing of the inner cable 123 from the pulled position, the arm portion 58 turns clockwise (in a direction of an arrow) under the spring force of the pull spring 72. This clockwise turning of the arm portion 58 moves the pressing roller 59 to the tightening position P8 to tighten the inner cable 46.

Since the throttle lever 27 is in the high engine speed position P7 with the inner cable 46 being tightened by the pressing roller 59, the distal end 46*b* of the inner cable 46 is pulled backward to move the throttle arm 14*b* of the throttle valve 14 to the high speed position P11, such that a speed of the engine 13 is automatically increased to a high speed.

Figure 27:
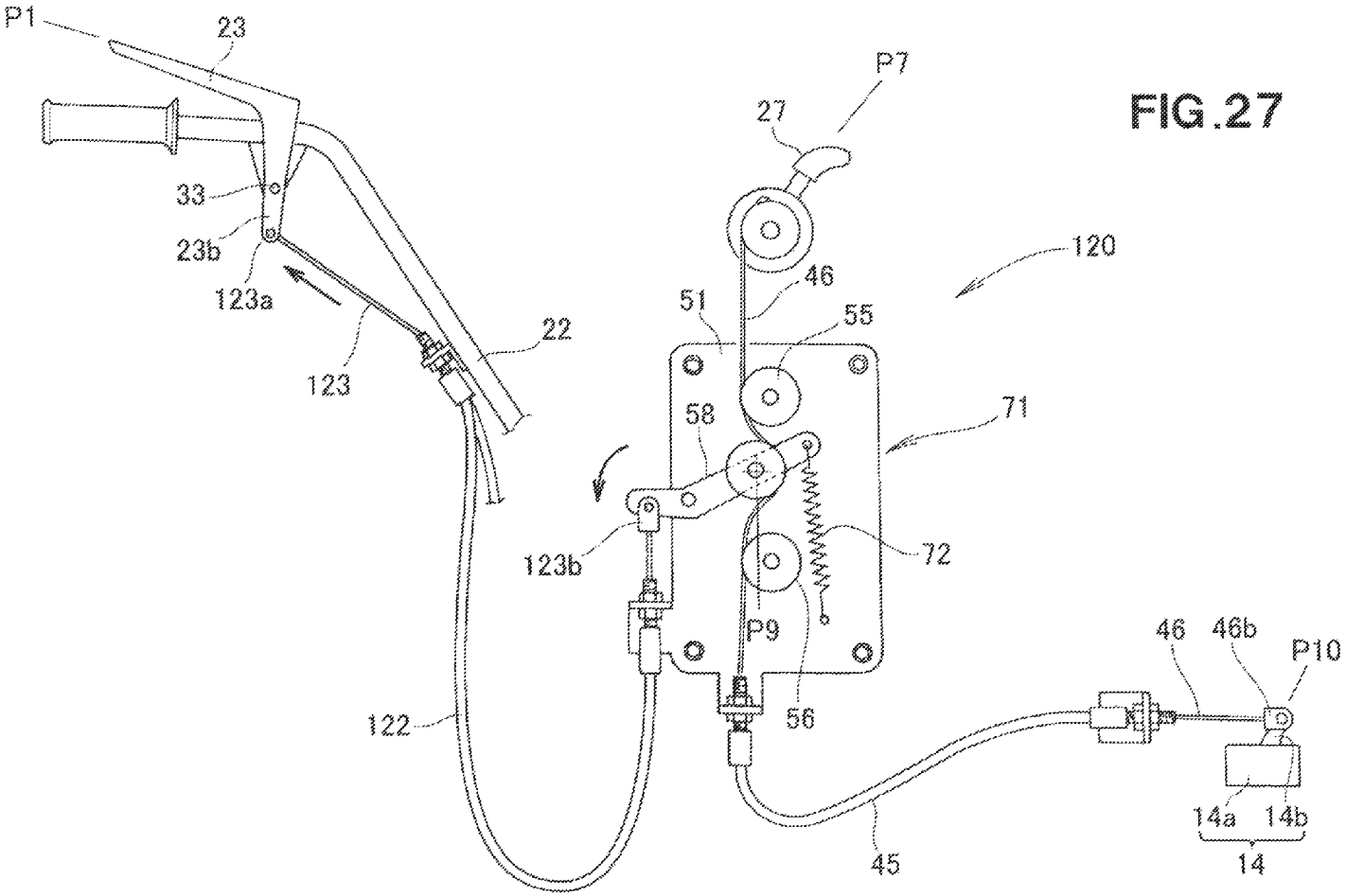
FIG. 27 is a view showing how to slacken a throttle cable of the working machine of FIG. 26.

The clutch lever 23 is then switched to the clutch disengaged position (non-operated position) P1, as shown in FIG. 27, thereby pulling the inner cable 123 in a direction of an arrow. This pull on the inner cable 123 turns the arm portion 58 counterclockwise (in a direction of an arrow) against the spring force of the pull spring 72. The counterclockwise turning of the arm portion 58 moves the pressing roller 59 to the slackening position P9 to slacken the inner cable 46. This allows the throttle arm 14*b* of the throttle valve 14 to move back to the low speed position P10 under the spring force of the return spring (not shown), thereby decreasing a speed of the engine 13.

By switching the clutch lever 23 to the clutch disengaged position P1, that is, the speed of the engine 13 can be automatically decreased.

In the working machine 120 in the fifth embodiment, as discussed above, by switching the clutch lever 23 to the operated position or the non-operated position, the speed of the engine 13 can be automatically adjusted between the low speed and the high speed. Furthermore, the working machine 120 can effect cost reduction like the working machines 10, 70 in the first and second embodiments.

It is noted that the working machine according to the present invention is not limited to the working machines in the first to fifth embodiments, but may be modified without departing from the spirit and scope of the invention. For example, the working machine may be a tiller or a bush cutter. Where the working machine is the tiller, it may include a tilling mechanism. Where the working machine is the bush cutter, it may include a bush cutting mechanism. It is noted that although the guide members have been described as the upper and lower guide rollers 55, 56 in the first to fifth embodiments, these guide members may be members other than the rollers. It is also noted that the throttle cable clamping portion has been described as the pressing roller 59 in the first to fifth embodiments, it may be a member other than the roller. It is also noted that the engine 13, the throttle valve 14, the clutch lever 23, the shift lever 25, the throttle lever 27 the throttle cable 45, the upper and lower guide rollers 55, 56, the throttle cable tightening/loosening means 57, the arm portion 58, the pressing roller 59, the return spring 63, the connecting means 64, 73, the pull spring 72, and the connecting/pull 92 are not limited those described above, but may have configurations or structures modified without departing from the spirit and scope of the present invention.

The present invention is suitable for a working machine designed to adjust a speed of an engine, depending upon whether the working machine is set in an operated position or a non-operated position.

Obviously, various minor changes and modifications of the present invention are possible in light of the above teaching. It is therefore to be understood that within the scope of the appended claims the invention may be practiced otherwise than as specifically described.

What is claimed is:

1. A working machine (10; 70; 90; 100; 120) comprising:

an engine (13);

engine speed controlling means (14) for controlling a speed of the engine (13);

a throttle lever (27);

a throttle cable (45) interconnecting the throttle lever (27) and the engine speed controlling means (14) for transmitting an amount of operation of the throttle lever (27) to the engine speed controlling means (14);

a plurality of guide members (55, 56) spaced from one another for guiding the throttle cable (45);

a throttle cable clamping portion (59) located between the guide members (55, 56) for pressing the throttle cable (45) against the guide members (55, 56) so as to tighten the throttle cable (45);

a pivotable arm portion (58) having the throttle cable clamping portion (59);

a connecting portion (73; 101) connected to the arm portion (58); and an operating portion (25) connected to the connecting portion (73; 101) and operable to move the throttle cable clamping portion (59) between a tightening position (P8) to press the throttle cable (45) against the guide members (55, 56) so as to tighten the throttle cable (45) and a slackening position (P9) to slacken the throttle cable (45)

wherein the operating portion includes a curved arm portion (74; 102) connected to a connecting cable (76; 104) which moves the throttle cable clamping portion (59).

2. The working machine of claim 1, further comprising pulling means (72) connected to the arm portion (58) for pulling the arm portion (58) to urge the throttle cable clamping portion (59) to the tightening position (P8), wherein the operating means (25) is switchable to an non-operated position (P5) to move the throttle cable clamping portion (59) to the slacking position (P9) against an urging force exerted by the pulling means (72) on the throttle cable clamping portion (59).

3. The working machine of claim 1, further comprising urging means (63) connected to the arm portion (58) for urging the throttle cable clamping portion (59) to the slackening position (P9), wherein the operating means (23) is switchable to an operated position (P2) to move the throttle cable clamping portion (59) to the tightening position (P8) against an urging force exerted by the urging means (63) on the throttle cable clamping portion (59).

* * * * *